US010964520B2

(12) United States Patent
Stewart et al.

(10) Patent No.: US 10,964,520 B2
(45) Date of Patent: Mar. 30, 2021

(54) MULTI-REFLECTION MASS SPECTROMETER

(71) Applicant: Thermo Fisher Scientific (Bremen) GmbH, Bremen (DE)

(72) Inventors: Hamish Stewart, Bremen (DE); Dmitry E. Grinfeld, Bremen (DE); Alexander A. Makarov, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 16/697,329

(22) Filed: Nov. 27, 2019

(65) Prior Publication Data

US 2020/0243322 A1 Jul. 30, 2020

(30) Foreign Application Priority Data

Dec. 21, 2018 (GB) ..... 1820950

(51) Int. Cl.
*H01J 49/40* (2006.01)
*H01J 49/06* (2006.01)
*H01J 49/00* (2006.01)

(52) U.S. Cl.
CPC ..... *H01J 49/406* (2013.01); *H01J 49/061* (2013.01); *H01J 49/004* (2013.01)

(58) Field of Classification Search
CPC ..... H01J 49/061; H01J 49/40; H01J 49/401; H01J 49/403; H01J 49/406; H01J 49/408
See application file for complete search history.

(56) References Cited

U.S. PATENT DOCUMENTS 7,326,925 B2 2/2008 Verentchikov et al.
8,237,111 B2 * 8/2012 Golikov ..... H01J 49/406 250/287

(Continued)

FOREIGN PATENT DOCUMENTS

CN 107851549 A 3/2018
GB 2403063 A 12/2004

(Continued)

OTHER PUBLICATIONS

Combined Search and Examination dated May 24, 2019, to GB Patent Application No. 1820950.2.

(Continued)

*Primary Examiner* — David E Smith

(57) ABSTRACT

A multi-reflection mass spectrometer comprising two ion mirrors spaced apart and opposing each other in a direction X, each mirror elongated generally along a drift direction Y, the drift direction Y being orthogonal to the direction X, a pulsed ion injector for injecting pulses of ions into the space between the ion mirrors, the ions entering the space at a non-zero inclination angle to the X direction, the ions thereby forming an ion beam that follows a zigzag ion path having N reflections between the ion mirrors in the direction X whilst drifting along the drift direction Y, a detector for detecting ions after completing the same number N of reflections between the ion mirrors, and an ion focusing arrangement at least partly located between the opposing ion mirrors and configured to provide focusing of the ion beam in the drift direction Y, such that a spatial spread of the ion beam in the drift direction Y passes through a single minimum at or immediately after a reflection having a number between 0.25N and 0.75N, wherein all detected ions are detected after completing the same number N of reflections between the ion mirrors.

48 Claims, 22 Drawing Sheets

(56) References Cited

U.S. PATENT DOCUMENTS

| | | | | |
|---|---|---|---|---|
| 9,136,100 | B2 | 9/2015 | Giles et al. | |
| 9,136,101 | B2 * | 9/2015 | Grinfeld | H01J 49/0027 |
| 9,679,758 | B2 | 6/2017 | Grinfeld et al. | |
| 2006/0214100 | A1 | 9/2006 | Verentchikov et al. | |
| 2011/0186729 | A1 | 8/2011 | Verentchikov et al. | |
| 2011/0284737 | A1 | 11/2011 | Makarov et al. | |
| 2012/0138785 | A1 | 6/2012 | Makarov et al. | |
| 2013/0056627 | A1 | 3/2013 | Verentchikov | |
| 2014/0175274 | A1 | 6/2014 | Makarov et al. | |
| 2014/0239172 | A1 * | 8/2014 | Makarov | H01J 49/02 250/282 |
| 2015/0028197 | A1 | 1/2015 | Grinfeld et al. | |
| 2015/0028198 | A1 | 1/2015 | Grinfeld et al. | |
| 2016/0018368 | A1 | 1/2016 | Sapargaliyev | |
| 2017/0098533 | A1 | 4/2017 | Stewart et al. | |
| 2018/0138026 | A1 | 5/2018 | Stewart et al. | |
| 2018/0144921 | A1 | 5/2018 | Hoyes et al. | |
| 2018/0330936 | A1 | 11/2018 | Hoyes et al. | |
| 2018/0350576 | A1 * | 12/2018 | Giannakopulos | H01J 49/10 |

FOREIGN PATENT DOCUMENTS

| | | | |
|---|---|---|---|
| GB | 2478300 | A | 9/2011 |
| JP | 2007526596 | A | 9/2007 |
| JP | 2011-528487 | A | 11/2011 |
| JP | 2012-528432 | A | 11/2012 |
| JP | 2015506566 | A | 3/2015 |
| JP | 2016-006795 | A | 1/2016 |
| JP | 2017-195183 | A | 10/2017 |
| JP | 2018-517244 | A | 6/2018 |
| SU | 1725289 | A1 | 4/1992 |
| WO | WO-2008047891 | A2 | 4/2008 |
| WO | WO-2010008386 | A1 | 1/2010 |
| WO | WO-2013110587 | A2 | 8/2013 |
| WO | WO-2017091501 | A1 | 6/2017 |
| WO | 2019030472 | A1 | 2/2019 |

OTHER PUBLICATIONS

Greenwood et al., "A Comb-Sampling Method for Enhanced Mass Analysis in Linear Electrostatic Ion Traps," Review of Scientific Instruments, Issue 82, 034103, 2011.

Hawkes, P.W et al., "Principles of Electron Optics—vol. 2: Applied Geometrical Optics", Journal of Microscopy, vol. 165, Pt. 1, Jan. 1992, pp. 189-190. [Book review].

Search Report dated Dec. 17, 2020, to JP Patent Application No. 2019-220903.

Notice of Refusal dated Dec. 24, 2020, to JP Patent Application No. 2019-220903.

* cited by examiner

MULTI-REFLECTION MASS SPECTROMETER

CROSS-REFERENCE TO RELATED APPLICATIONS

This application claims the priority to GB Patent Application No. 1820950.2, filed on Dec. 21, 2018, which application is hereby incorporated herein by reference in its entirety.

FIELD OF THE INVENTION

This invention relates to the field of mass spectrometry, in particular time-of-flight mass spectrometry and electrostatic trap mass spectrometry. The invention especially relates to time-of-flight mass spectrometry and electrostatic trap mass spectrometry utilizing multi-reflection techniques for extending the ion flight path and increasing mass resolution.

BACKGROUND

Time of flight (ToF) mass spectrometers are widely used to determine the mass to charge ratio (m/z) of ions on the basis of their flight time along a flight path. In ToF mass spectrometry, short ion pulses are generated by a pulsed ion injector and directed along a prescribed flight path through an evacuated space to reach an ion detector. The detector then detects the arrival of the ions and provides an output to a data acquisition system. The ions in a pulse become separated according to their m/z based on their time-of-flight along the flight path and arrive at the detector as time-separated short ion packets.

Various arrangements utilizing multi-reflections to extend the flight path of ions within mass spectrometers are known. Flight path extension is desirable to increase time-of-flight separation of ions within time-of-flight (ToF) mass spectrometers or to increase the trapping time of ions within electrostatic trap (EST) mass spectrometers. In both cases the ability to distinguish small mass differences between ions is thereby improved. Improved resolution, along with advantages in increased mass accuracy and sensitivity that typically come with it, is an important attribute for a mass spectrometer for a wide range of applications, particularly with regard to applications in biological science, such as proteomics and metabolomics for example.

Mass resolution in time-of-flight mass spectrometers is known to increase in proportion to the length of the ions' flight path, assuming that ion focal properties remain constant. Unfortunately, ion energy distributions and space charge interactions can cause ions to spread out in flight, which in long systems can cause them to be lost from the analyser or to reach the detector at a highly aberrant time-of-flight.

Giles and Gill disclosed in U.S. Pat. No. 9,136,100 that additional focusing lenses at an intermediate position within the flight tube of a conventional single reflection ToF analyser, as shown in FIG. 1, were sufficient to greatly reduce beam divergence at the ion mirror and the detector, allowing an increase in the length of the ion flight path.

Nazerenko et al in SU1725289 disclosed a multi-reflection time-of-flight analyser (MR-ToF) composed of two opposing ion mirrors, elongated in a drift direction. Ions oscillate between the mirrors whilst they drift down the length of the system, in the drift direction, to a detector, such that the ions follow a zigzag flight path, reflecting between the mirrors and thereby resulting in the folding of a long flight path into a relatively compact volume as illustrated in FIG. 2. A problem is that the system has no means to reduce ion beam divergence in the drift direction so that only a few reflections are possible until the beam is wider than any detector. Another problem with an uncontrolled beam expansion is that it can become possible for ions from different numbers of reflections to reach the detector, creating additional "overtone" peaks for ions of a single m/z. To address this problem, Verenchikov in GB2478300 proposed allowing or inducing beam divergence in such a system and using signal processing to generate single peaks from the data. A long focus lens between the ion source and detector is used to alter the number and/or position of overtones.

A solution to the problem of drift divergence has been demonstrated by Verenchikov in GB2403063. The solution uses periodically spaced lenses located within the field-free region between the two parallel elongated opposing mirrors as shown in FIG. 3. The periodic lenses provide regular drift focusing after every reflection, every other reflection, or every few reflections. Instruments based on this design have shown high resolutions of 50,000-100,000 and higher. A major downside is that the ion path is strictly defined by the lens position, and requires precise alignment of the many elements to minimise ToF aberrations and ion losses. In this arrangement the number of reflections is set by the position of the lenses and there is no possibility to change the number of reflections and thereby the flight path length by altering the ion injection angle. The restricted spatial acceptance of the lenses also requires a very tightly focused beam, leaving the system relatively susceptible to space charge effects with higher ion populations. To further increase the path length, it was proposed that a deflector be placed at the distal end of the mirror structure from the ion injector, so that the ions may be deflected back through the mirror structure, doubling the flight path length. However, the use of a deflector in this way is prone to introducing beam aberrations which will ultimately limit the maximum resolving power that can be obtained.

Sudakov in WO2008/047891 also disclosed a system comprising two opposing ion mirrors, elongated in a drift direction, but proposed an alternative means for both doubling the flight path length by returning ions back along the drift length and at the same time inducing beam convergence in the drift direction. Sudakov proposed segmentation of the opposing mirrors to create a superimposed third mirror in the drift direction as shown in FIG. 4A, such that ions with substantial variations in drift velocity were allowed to spread out and then be reflected back to a focus at the front of the mirror. The third mirror was thus oriented perpendicularly to the opposing mirrors and located at the distal end of the opposing mirrors from the ion injector. The ions in such a system are allowed to diverge in the drift direction as they proceed through the analyser from the ion injector but the third ion mirror reverses this divergence. After reflection in the third mirror, upon arriving back in the vicinity of the ion injector the ions are once again converged in the drift direction. This advantageously allows the ion beam to be spread out in space throughout most of its journey through the analyser, reducing space charge interactions, as well as avoiding the use of multiple periodic structures along or between the mirrors for ion focusing. The third mirror also induces spatial focusing with respect to initial ion energy in the drift direction. However, the third mirror is necessarily built into the structure of the two opposing elongated mirrors and effectively sections the elongated mirrors, i.e. the elongated mirrors are no longer continuous. Such a system was theoretically highly advantageous as it more than doubled the flight path, and the high beam divergence meant good space charge tolerance, as well as ability to alter injection angle and with few intrinsic ToF aberrations (for example like those induced by periodic lenses, or by using a strong deflector to turn the ion beam back in the drift direction). Unfortunately, the strong electric fields between the segments of the opposing mirrors that are required to integrate the third mirror into the electrode structure causes scattering of the ion beam, which is an effect that can only be limited with a high number of segments thereby making mirror construction very complex.

Grinfeld and Makarov in U.S. Pat. No. 9,136,101 disclosed a practical way of achieving reflection in the drift direction in a system compromising two opposing ion mirrors, elongated in the drift direction. They disclosed reflection in the drift direction provided by converging opposing mirrors, which create a pseudo-potential gradient along the drift direction that acts as an ion mirror to reverse the ion drift velocity as well as spatially focus the ions in the drift direction to a focal point where a detector is placed. A specially shaped central correction or compensation electrode is used to correct ToF aberrations induced by the non-constant mirror separation. This arrangement, shown in FIG. 4B, avoids scattering of the ion beam and both eliminates the need for a complex mirror construction and the need for a third ion mirror as proposed by Sudakov. However, the balancing between mirror convergence and correction electrode potential still necessitates a high mechanical accuracy.

In view of the above, it can be seen that improvements are still desired in multi-reflection time-of-flight (MR ToF) and electrostatic trap (MR-EST) mass spectrometers. Desired properties of such spectrometers include extended flight path in a time-of-flight analyser to provide high resolution (e.g. >50K), whilst maintaining relatively compact size, high ion transmission, robust construction with tolerance to small mechanical deviations.

SUMMARY OF THE INVENTION

The present invention provides in one aspect a multi-reflection mass spectrometer comprising:

- two ion mirrors spaced apart and opposing each other in a direction X, each mirror elongated generally along a drift direction Y, the drift direction Y being orthogonal to the direction X,
- a pulsed ion injector for injecting pulses of ions into the space between the ion mirrors, the ions entering the space at a non-zero inclination angle to the X direction, the ions thereby forming an ion beam that follows a zigzag ion path having N reflections between the ion mirrors in the direction X whilst drifting along the drift direction Y,
- a detector for detecting ions after completing the same number N of reflections between the ion mirrors, and
- an ion focusing arrangement at least partly located between the opposing ion mirrors and configured to provide focusing of the ion beam in the drift direction Y, such that a spatial spread of the ion beam in the drift direction Y passes through a single minimum at or immediately after a reflection having a number between 0.25N and 0.75N, wherein all detected ions are detected by the detector after completing the same number N of reflections between the ion mirrors.

The ion focusing arrangement ensures that the detector detects only ions that have completed exactly the same number N of reflections between the ion mirrors, i.e. N reflections between leaving the ion injector and being detected by the detector.

Preferably, due to the focusing properties of the ion focusing arrangement, the ion beam width in the drift direction Y is substantially the same at the ion detector as at the ion focusing arrangement. The spatial spread of the ion beam in the drift direction on the first reflection is preferably substantially the same as the spatial spread of the ion beam in the drift direction on the N-th reflection. Preferably, the spatial spread of the ion beam in the drift direction Y passes through a single minimum that is substantially halfway along the ion path between the ion focusing arrangement and the detector.

Preferably, the ion focusing arrangement comprises a drift focusing lens or pair of drift focusing lenses for focusing the ions in the drift direction Y. Preferably at least one drift focusing lens is a converging lens (i.e. has a converging effect on the ion beam width, especially in the drift direction Y). Preferably, the converging lens focuses the ions such that the spatial spread of the ion beam in the drift direction Y has a maximum at the converging lens that is 1.2-1.6 times, or about $\sqrt{2}$ times, the minimum spatial spread. Furthermore, preferably the spatial spread of the ion beam in the drift direction Y has a maximum at the converging lens that is in the range 2× to 20× an initial spatial spread of the ion beam in the drift direction Y at the ion injector. The drift focusing lens (or lenses) is preferably located centrally in the space between the ion mirrors, i.e. halfway between the ion mirrors, in the X direction, although in some embodiments the lens (lenses) may be located away from this central position in the X direction.

The ion beam undergoes a total of K oscillations between the ion mirrors from the ion injector to the ion detector. In each oscillation the ions travel a distance that is double the mirror separation distance and thus K is equal to N/2, where N is the total number of reflections between the mirrors. The value K is preferably a value within a range that is +/−50%, or +/−40%, or +/−30%, or +/−20%, or +/−10% around an optimum value, $K_{(opt)}$ given by:

$$K(opt) = \left(\frac{D_L^2}{4\,\Pi\,W}\right)^{1/3}$$

wherein $D_L$ is the drift length travelled by the ion beam in the drift direction Y, Π is the phase volume wherein $\Pi=\delta\alpha_i\cdot\delta x_i$ and $\delta\alpha_i$ is the initial angular spread and $\delta x_i$ is the initial spatial spread of the ion beam at the ion injector, and W is the distance between the ion mirrors in the X direction. It is preferable that the angular spread of the ion beam, $\delta\alpha_i$ after focusing by the ion focusing arrangement is within a range that is +/−50%, or +/−40%, or +/−30%, or +/−20%, or +/−10% around an optimum value, $\delta\alpha_{(opt)}$ given by:

$$\delta\alpha(opt) = \sqrt{\frac{2\Pi}{WK(opt)}}$$

Preferably, the initial spatial spread of the ion beam in the drift direction Y at the ion injector, $\delta x_i$, is 0.25-10 mm or 0.5-5 mm.

The ion focusing arrangement is preferably located before the $N/4^{th}$ reflection in the ion mirrors or before a reflection having a number less than 0.25N. In some preferred embodiments, the ion focusing arrangement comprises a drift focusing lens positioned after a first reflection and before a fifth reflection in the ion mirrors (especially before a fourth, third or second reflection). More preferably, the ion focusing arrangement comprises a drift focusing lens positioned after a first reflection in the ion mirrors and before a second reflection in the ion mirrors. In some preferred embodiments, the ion focusing arrangement has only a single drift focusing lens positioned after the first reflection and before the detector. In such embodiments, the single drift focusing lens is preferably positioned after the first reflection and before a second reflection in the ion mirrors.

Preferably, the drift focusing lens, or lenses where more than one drift focusing lens is present, comprises a trans-axial lens, wherein the trans-axial lens comprises a pair of opposing lens electrodes positioned either side of the beam in a direction Z, wherein direction Z is perpendicular to directions X and Y. Preferably, each of the opposing lens electrodes comprises a circular, elliptical, quasi-elliptical or arc-shaped electrode. In some embodiments, each of the pair of opposing lens electrodes comprises an array of electrodes separated by a resistor chain to mimic a field curvature created by an electrode having a curved edge. In some embodiments, the opposing lens electrodes are each placed within an electrically grounded assembly. In some embodiments, the lens electrodes are each placed within a deflector electrode. Further preferably each deflector electrode placed within an electrically grounded assembly. The deflector electrodes preferably have an outer trapezoid shape that acts as a deflector of the ion beam.

In some embodiments, the drift focusing lens comprises a multipole rod assembly. In some embodiments, the drift focusing lens comprises an Einzel lens (a series of electrically biased apertures).

In some preferred embodiments, the ion focusing arrangement comprises a first drift focusing lens that is a diverging lens in the drift direction Y (i.e. has a diverging effect on the ion beam width, especially in the drift direction Y) and a second drift focusing lens that is a converging lens in the drift direction Y), the second drift focusing lens being downstream of the first drift focusing lens. In some preferred embodiments, the ion focusing arrangement comprises a first drift focusing lens positioned before the first reflection in the ion mirrors for focusing the ion beam in the drift direction Y, wherein the first drift focusing lens is a diverging lens, and a second drift focusing lens positioned after the first reflection in the ion mirrors for focusing the ion beam in the drift direction Y, wherein the second drift focusing lens is a converging lens (i.e. has a converging effect on the ion beam width, especially in the drift direction Y).

In some embodiments, the ion focusing arrangement comprises at least one injection ion deflector positioned before the first reflection in the ion mirrors, for example for adjusting the inclination angle of the ion beam as it is injected. Preferably, the inclination angle to the X direction of the ion beam is determined by an angle of ion ejection from the pulsed ion injector relative to the direction X and/or a deflection caused by the injection deflector positioned before the first reflection in the ion mirrors. In certain embodiments, the first drift focusing lens can be placed within the at least one injection deflector. In some embodiments, the ion focusing arrangement comprises at least one ion deflector positioned after the first reflection in the ion mirrors but preferably before the fourth, third or most preferably second reflections, optionally in addition to an injection ion deflector positioned before the first reflection. The ion deflector positioned after the first reflection may be used to adjust or optimise the ion beam alignment. In some preferred embodiments, the mass spectrometer further comprises one or more compensation electrodes extending along at least a portion of the drift direction Y in or adjacent the space between the mirrors for minimising time of flight aberrations, e.g. caused by beam deflections.

In some embodiments, a reversing deflector is located at a distal end of the ion mirrors from the ion injector to reduce or reverse the drift velocity of the ions in the direction Y. In such embodiments, preferably a further drift focusing lens is located between the opposing ion mirrors one, two or three reflections before the reversing deflector to focus the ion beam to a focal minimum within the reversing deflector. In some a further drift focusing lens is positioned within, or proximate (adjacent) to, the reversing deflector to focus the ion beam to a focal minimum within one of the ion mirrors at the next reflection after the reversing deflector. In such embodiments, preferably the ion beam passes through the reversing deflector twice, on each pass receiving half the deflection need to completely reverse the ion drift velocity such that after the second pass the ion drift velocity is completely reversed.

In some embodiments, wherein the detector is located at an opposite end of the ion mirrors in the drift direction Y from the ion injector, the ion mirrors diverge from each other along a portion of their length in the direction Y as the ions travel towards the detector. In some embodiments, starting from the end of the ion mirrors closest to the ion injector, the ion mirrors converge towards each other (decreasing distance between the mirrors) along a first portion of their length in the direction Y and diverge from each other (increasing distance between the mirrors) along a second portion of their length in the direction Y, the second portion of length being adjacent the detector.

In some embodiments, the mass spectrometer can be used for imaging, wherein the detector is an imaging detector, such as a 2D or pixel detector, i.e. a position sensitive detector.

In another aspect, the present invention provides a method of mass spectrometry. The mass spectrometer of the present invention may be used to perform the method. The features of the mass spectrometer thus also apply mutatis mutandis to the method. The method of mass spectrometry comprises:

- injecting ions into a space between two ion mirrors that are spaced apart and opposing each other in a direction X, each mirror elongated generally along a drift direction Y, the drift direction Y being orthogonal to the direction X, the ions entering the space at a non-zero inclination angle to the X direction, the ions thereby forming an ion beam that follows a zigzag ion path having N reflections between the ion mirrors in the direction X whilst drifting along the drift direction Y,
- focusing the ion beam in the drift direction Y using an ion focusing arrangement at least partly located between the opposing ion mirrors, such that a spatial spread of the ion beam in the drift direction Y passes through a single minimum at or immediately after a reflection having a number between 0.25N and 0.75N, and
- detecting ions after the ions have completed the same number N of reflections between the ion mirrors. Thus, all detected ions are detected after completing the same number N of reflections between the ion mirrors and no overtones are detected.

Preferably, the focusing is such that the spatial spread of the ion beam in the drift direction on the first reflection is substantially the same as the spatial spread of the ion beam in the drift direction on the N-th reflection. Preferably, the focusing is such that the spatial spread of the ion beam in the drift direction Y passes through a single minimum that is substantially halfway along the ion path between the ion focusing arrangement and the detector. Preferably, the ion beam undergoes K oscillations between the ion mirrors and K is a value within a range that is +/−50%, or +/−40%, or +/−30%, or +/−20%, or +/−10% around an optimum value, $K_{(opt)}$ given by:

$$K(opt) = \left(\frac{D_L^2}{4\Pi W}\right)^{1/3}$$

wherein $D_L$ is the drift length travelled by the ion beam in the drift direction Y, Π is the phase volume wherein $\Pi=\delta\alpha_i$, $\delta x_i$ and $\delta\alpha_i$ is an initial angular spread and $\delta x_i$ is an initial spatial spread of the ion beam, and W is the distance between the ion mirrors in the X direction.

Preferably, the angular spread of the ion beam, δα, after focusing is within a range that is +/−50%, or +/−40%, or +/−30%, or +/−20%, or +/−10% around an optimum value, $\delta\alpha_{(opt)}$ given by:

$$\delta\alpha(opt) = \sqrt{\frac{2\Pi}{WK(opt)}}.$$

Preferably, the focusing is performed using an ion focusing arrangement located before a reflection having a number less than 0.25N in the ion mirrors. Preferably, an initial spatial spread of the ion beam in the drift direction Y at an ion injector, $\delta x_i$, is 0.25-10 mm or 0.5-5 mm.

Preferably, the ion focusing arrangement comprises a drift focusing lens positioned after a first reflection in the ion mirrors and before a fifth reflection in the ion mirrors.

In some embodiments, the method further comprises deflecting the ion beam using a deflector positioned after a first reflection in the ion mirrors and before a fifth reflection in the ion mirrors.

In some embodiments of the method, the ion focusing arrangement comprises a first drift focusing lens positioned before the first reflection in the ion mirrors for focusing the ion beam in the drift direction Y, wherein the first drift focusing lens is a diverging lens, and a second drift focusing lens positioned after the first reflection in the ion mirrors for focusing the ion beam in the drift direction Y, wherein the second drift focusing lens is a converging lens.

In some embodiments, the method comprises deflecting the ion beam using an injection deflector positioned before the first reflection in the ion mirrors.

In some embodiments, the method further comprises adjusting the inclination angle to the X direction of the ion beam by deflecting the ion beam using the injection deflector.

In some embodiments, the method further comprises applying one or more voltages to respective one or more compensation electrodes extending along at least a portion of the drift direction Y in or adjacent the space between the mirrors to minimise time of flight aberrations.

In some embodiments, the method further comprises deflecting the ion beam using a reversing deflector at a distal end of the ion mirrors from the injection to reduce or reverse the drift velocity of the ions in the direction Y. In some such embodiments, the method further comprises focusing the ion beam to a focal minimum within the reversing deflector. In some embodiments, the method further comprises a focusing lens within or proximate (adjacent) to the reversing deflector and focusing the ion beam to a focal minimum within one of the ion mirrors at the next reflection after the reversing deflector. In such embodiments, preferably the ion beam passes through the reversing deflector twice, on each pass receiving half the deflection need to completely reverse the ion drift velocity such that after the second pass the ion drift velocity is completely reversed.

In some embodiments, the detecting comprises forming a 2-D image of an ion source, e.g. on an imaging detector, such as a 2D or pixel detector.

Problems in extended path multi-reflection time of flight mass spectrometers can arise from the need to control ion beam divergence within the analyser, as ions can become lost from the system or reach the detector at aberrant times, harming sensitivity and resolution or complicating the mass spectrum. Prior art methods have met with some success in this regard but generally require the highest mechanical precision and alignment and/or complicated construction. GB2478300 proposed allowing beam divergence in such a system and using signal processing to generate single peaks from the data. This prior art mentions the possibility of using a long focus lens between the ion source and detector to alter the number and position of overtones (by altering drift focal properties), whereas the present disclosure describes the use of a drift focusing arrangement to eliminate overtones. Furthermore, the present disclosure does not comprise regular or periodic focusing lenses after every reflection, every other reflection or every few reflections, e.g. of the type of periodic focusing lenses shown in GB2403063. Compared to periodic focusing, the present invention is simpler, more tuneable and easier to align, whilst allowing for a more diffuse ion beam and thus better space charge performance.

This disclosure details the use of a long drift focus ion lens, or in some embodiments pair of ion lenses (e.g. in a telescopic configuration where a first one diverges the beam and a second one converges the beam), to reduce the drift spread of an ion beam within a multi-reflection ToF (MR-ToF) analyser or multi-reflection electrostatic trap (MR-EST) analyser. In this way, approximately all ions from an ion source or injector are brought to a detector over a reasonably long, e.g. >10 m, ion flight path and without substantial introduced ToF aberrations. Thus, high mass resolution and high ion transmission can be achieved. The use of a further drift focusing lens within the ion injection region is also advantageous as the combination of two lenses allows a doubling of the initial spatial distribution of the ion beam, or alternatively a doubling of the flight path before alternating trajectories overlap.

The present invention is also designed to be more tolerant to mechanical error than the converging mirror system disclosed in U.S. Pat. No. 9,136,101.

Preferably, methods of mass spectrometry using the present invention comprise injecting ions into the multi-reflection mass spectrometer from one end of the opposing ion-optical mirrors, the ions having a component of velocity in the drift direction Y.

A pulsed ion injector injects pulses of ions into the space between the ion mirrors at a non-zero inclination angle to the X direction, the ions thereby forming an ion beam that follows a zigzag ion path N reflections between the ion mirrors in the direction X whilst drifting along the drift direction Y. N is an integer value of at least 2. Thus, the ion beam undergoes at least 2 reflections between the ion mirrors in the direction X whilst drifting along the drift direction Y.

Preferably, the number N of ion reflections in the ion mirrors along the ion path from the ion injector to the detector is at least 3, or at least 10 or at least 30, or at least 50, or at least 100. Preferably, the number N of ion reflections in the ion mirrors along the ion path from the ion injector to the detector is from 2 to 100, 3 to 100, or 10 to 100, or over 100, e.g. one of the groups: (i) from 3 to 10; (ii) from 10 to 30; (iii) from 30 to 100; (iv) over 100.

Ions injected into the spectrometer are preferably repeatedly reflected back and forth in the X direction between the mirrors, whilst they drift down the Y direction of mirror elongation (in the +Y direction). Overall, the ion motion follows a zigzag path.

In certain embodiments, as described hereafter, after a number of reflections (typically N/2), the ions can be reversed in their drift velocity along Y and then repeatedly reflected back and forth in the X direction between the mirrors whilst they drift back up the Y direction.

For convenience herein, the drift direction shall be termed the Y direction, the opposing mirrors are set apart from one another by a distance in what shall be termed the X direction, the X direction being orthogonal to the Y direction, this distance can be the same (such that the ion mirrors lie substantially parallel) or can vary at different locations along the Y direction. The ion flight path, simply termed herein the ion path, generally occupies a volume of space which extends in the X and Y directions, the ions reflecting between the opposing mirrors (in the X direction) and at the same time progressing along the drift direction Y. Generally, the ion beam undergoes an average shift dY in the drift direction Y per single ion reflection.

The mirrors typically being of smaller dimensions in the perpendicular Z direction (Z being perpendicular to X and Y), the volume of space occupied by the ion flight path is typically a slightly distorted rectangular parallelepiped with a smallest dimension preferably being in the Z direction. For convenience of the description herein, ions are injected into the mass spectrometer with initial components of velocity in the +X and +Y directions, progressing initially towards a first ion mirror located in a +X direction and along the drift length in a +Y direction. Thus, after the first reflection in the first ion mirror, the reflected ions travel in the −X direction toward the second ion mirror still with velocity in the +Y direction. After the second reflection, the ions again travel in the +X and +Y direction and so on. The average component of ion velocity in the Z direction is preferably zero.

The resolving power is dependent upon the initial angle of ion injection into the space between the mirrors (herein termed the inclination angle, which is the angle of ion injection to the X direction in the X-Y plane), which determines the drift velocity and therefore the overall time of flight. Ideally, this inclination angle of injection should be minimised to maximise the number of reflections and thus the ion path length and the mass resolving power, but such minimising of the inclination angle can be restricted by mechanical requirements of the injection apparatus and/or of the detector, especially for more compact designs. Advantageously, aspects of the present invention allow the number of ion oscillations within the mirrors structure and thereby the total flight path length to be altered by changing the ion injection angle.

In some embodiments, a deflector can be positioned between the mirrors to reduce the drift velocity after ion injection. In other embodiments, a decelerating stage, such as described in US 2018-0138026 A1, can be built into the mirror structure itself to reduce the drift velocity, e.g. after the first one or two reflections, and thus allow for an increase of the flight time and consequent resolution to be made. In such embodiments, there may be no need for an additional deflector to be incorporated between the mirrors, thus reducing the number of parts and cost.

The ion injector generally receives ions from an ion source, whether directly or indirectly via one or more ion optical devices (e.g. one or more of an ion guide, lens, mass filter, collision cell). The ion source ionises sample species to form the ions. Suitable ion sources are well known in the art, e.g. electrospray ionisation, chemical ionisation, atmospheric pressure chemical ionisation, MALDI etc. In some embodiments, the ion injector itself can be the ion source (e.g. MALDI source). The ion source may ionise multiple sample species, eg. from a chromatograph, to form the ions.

The ion injector is generally a pulsed ion source, i.e. injecting non-continuous pulses of ions, rather than a continuous stream of ions. As known in the art of ToF mass spectrometry, the pulsed ion injector forms short ion packets comprising at least a portion of said ions from the ion source. Typically, an acceleration voltage is applied by the ion injector to inject the ions into the mirrors, which can be several kV, such as 3 kV, 4 kV or 5 kV.

The ion injector may comprise a pulsed ion injector, such as an ion trap, an orthogonal accelerator, MALDI source, secondary ion source (SIMS source), or other known ion injection means for a ToF mass spectrometer. Preferably, the ion injector comprises a pulsed ion trap, more preferably a linear ion trap, such as a rectilinear ion trap or a curved linear ion trap (C-Trap). The ion injector is preferably located at the Y=0 position. The detector in some embodiments, where the ion flight is reversed in the Y direction after a number of reflections, can be similarly located at Y=0.

The ion injector preferably injects ion pulses of limited initial width in the drift direction Y. In an embodiment, the ion pulse can be generated from an ion cloud accumulated in an ion trap. It is then pulse-ejected into the ion mirrors. The trap may provide an ion cloud of limited width in the drift direction. In preferred embodiments, the ion cloud in the ion injector that is injected towards the ion mirrors has a width in the drift direction Y of 0.25 to 10 mm, or 0.5 to 10 mm, preferably 0.25 to 5 mm or 0.5-5 mm, e.g. 1 mm, or 2 mm, or 3 mm, or 4 mm. This thereby defines an initial ion beam width.

The ion injector injects ions from one end of the mirrors into the space between the mirrors at an inclination angle to the X axis in the X-Y plane such that ions are reflected from one opposing mirror to the other a plurality of times whilst drifting along the drift direction away from the ion injector so as to follow a generally zigzag path within the mass spectrometer.

The ion injector is preferably located proximate to one end of the opposing ion-optical mirrors in the drift direction Y so that ions can be injected into the multi-reflection mass spectrometer from one end of the opposing ion-optical mirrors in the drift direction (injection in the +Y direction).

The ion injector for injecting ions as an ion beam into the space between the ion mirrors at an inclination angle to the X direction preferably lies in the X-Y plane. Thereafter, the injected ions following their zigzag path between the ion mirrors in the X-Y plane. However, the ion injector can lie outside the X-Y plane such that ions are injected towards the X-Y plane and are deflected by a deflector when they reach the X-Y plane to thereafter follow their zigzag path between the ion mirrors within the X-Y plane. In some embodiments, C-shaped isochronous ion interfaces or sectors may be used for ion injection as disclosed in U.S. Pat. No. 7,326,925.

The ion focusing arrangement generally is located on the ion path. The ion focusing arrangement is generally positioned along the ion path between the ion injector and the detector. The ion focusing arrangement is preferably positioned along the ion path closer to the ion injector than the detector. For example, it is preferred to locate the ion focusing arrangement along the ion path between first and fifth reflections, or first and fourth reflections, or first and third reflections, or more preferably between the first and second reflections.

The ion focusing arrangement is at least partly located between the opposing ion mirrors. In some embodiments, the ion focusing arrangement is located wholly between the mirrors (i.e. in the space between the mirrors), and in other embodiments the ion focusing arrangement is located partly between the mirrors and partly outside the space between the mirrors. For example, one lens of the ion focusing arrangement can be located outside of the space between the ion mirrors while another lens of the ion focusing arrangement is located between the ion mirrors.

The ion focusing arrangement is configured to provide focusing of the ions in the drift direction. Typically, the ion focusing arrangement comprises a focusing lens that causes the ion beam to converge in the direct direction Y, herein referred to as a converging lens. The ion focusing arrangement or lens has a long focal length providing a single focal minimum (i.e. minimum spatial spread) in the drift direction Y along the ion path at or immediately after a reflection (i.e. before the next reflection) having a number between 0.25N and 0.75N, i.e. the spatial spread of the ion beam in the drift direction Y passes through a single minimum at or immediately after a reflection having a number between the 0.25N and 0.75N. Typically, a single focal minimum occurs approximately or substantially halfway between the first and last (N-th) reflections. For example, this means that the single focal minimum (minimum spatial spread) in the drift direction Y may occur along the ion path at a point that is halfway between the first and N-th reflections +/−20%, or +/−10%, or +/−5% of the total ion path length between the first and N-th reflections. In this way, the ion focusing arrangement generally can provide that the single focal minimum (minimum spatial spread) in the drift direction Y occurs approximately or substantially halfway along the ion path between the ion focusing arrangement (i.e. the converging lens of the ion focusing arrangement) and the detector. For example, the single focal minimum (minimum spatial spread) in the drift direction Y may occur along the ion path at a point that is halfway between the ion focusing arrangement (i.e. the converging lens of the ion focusing arrangement) and the detector +/−20% or +/−10% of the total ion path length between the ion focusing arrangement and the detector. Thus the ion focusing arrangement according to the present disclosure does not provide multiple focal minima (minima of spatial spread) in the drift direction Y along the ion path, unlike periodic focusing arrangements of the prior art.

Furthermore, the ion focusing arrangement through these focusing properties provides that the spatial spread of the ions in the drift direction Y on the first reflection is substantially the same (e.g. within +/−30%, +/−20%, or preferably +/−10%) as the spatial spread of the ions in the drift direction Y on the N-th reflection. The spatial spread on the first (or N-th) reflection herein means the spatial spread of the ions in the drift direction Y immediately downstream of the reflection, e.g. at the first crossing of the midpoint between the ion mirrors in the direction X after the first (or N-th) reflection. Similarly, this can provide that the spatial spread of the ions in the drift direction Y at the detector is substantially the same (e.g. within +/−30%, +/−20%, or preferably +/−10%) as the spatial spread of the ions in the drift direction Y at the ion focusing arrangement (i.e. the converging lens of the ion focusing arrangement). The spatial spread of the ions in the drift direction Y at the converging lens of the ion focusing arrangement (and preferably on the final, N-th reflection and/or at the detector) for a 0.25-10 mm or 0.5-5 mm initial ion beam width range (i.e. spatial spread in the drift direction Y) of 5-25 mm, or 5-15 mm. In preferred embodiments, the ion beam width in the drift direction Y at its maximum at the converging lens of the ion focusing arrangement is in the range 2 to 20 times (2× to 20×) the initial ion beam width (e.g. initial ion beam width from the pulses of ions at the ion injector, at an ejection point from the ion injector). This is determined by the phase volume of the ion beam, which is determined by the ion injector, as well as the dimensions of the mirrors (mirror separation distance (W) and mirror length in drift direction Y). In embodiments, the ion beam width or spatial spread of the ions in the drift direction Y at the single minimum (focal minimum or so-called gorge) is generally about $1/\sqrt{2}$ of the maximum ion beam width at the lens (for example, 0.65-0.75, or ~0.7 of the maximum ion beam width at the lens). Expressed conversely, the converging lens focuses the ions such that the spatial spread of the ion beam in the drift direction Y has a maximum at the converging lens that is 1.2 to 1.6 times, or 1.3-1.5 times, or about $\sqrt{2}$ times, the minimum spatial spread.

Advantageously, the focusing properties of the ion focusing arrangement ensure that substantially all or all detected ions are detected after completing the same number of reflections N between the ion mirrors. In this way, no overtones are detected, i.e. ions that have undergone a different number of reflections in the ion mirrors (more or less than N).

In some embodiments, at least one focusing lens (a so-called drift focusing lens that focuses ions at least or primarily in the drift direction Y) is located on the ion path. In some embodiments, at least two focusing lens are located on the ion path, for example a pair of lenses. In some such embodiments, a first focusing lens may be positioned before the first reflection of the ions in the ion mirrors and a second focusing lens may be positioned before the first reflection of the ions in the ion mirrors (e.g. between the first and fifth reflections, preferably between first and fourth reflections, or between first and third reflections or most preferably between first and second reflections). In some embodiments, the first focusing lens can be a lens that produces a divergence (increased spatial spread) of the ions in the drift direction Y (i.e. defocusing lens). A second focusing lens is then provided as a focusing lens that produces a convergence of the ions in the drift direction Y, in which the minimum of the spatial spread of the ions in the drift direction Y occurs substantially halfway along the ion path between the second lens of the ion focusing arrangement and the detector. Thus, the ion focusing arrangement can comprise one or more ion focusing lenses. In some embodiments wherein the ion focusing arrangement comprises a plurality of focusing lenses, the final lens on the ion path produces a convergence of the ions in the drift direction Y, in which the minimum of the spatial spread of the ions in the drift direction Y occurs substantially halfway along the ion path between the final lens of the ion focusing arrangement and the detector.

The present disclosure further provides a method of mass spectrometry comprising the steps of injecting ions into the multi-reflection mass spectrometer, for example in such form as a pulsed ion beam as known for ToF mass spectrometry, and detecting at least some of the ions during or after their passage through the mass spectrometer using the ion detector.

Ion detectors known in the art of ToF mass spectrometry can be used. Examples include SEM detectors or microchannel plates (MCP) detectors, or detectors incorporating SEM or MCP combined with a scintillator/photodetector. In some embodiments, the detector can be positioned at the opposite end of the ion mirrors in the drift direction Y to the ion injector. In other embodiments, the detector can be positioned in a region adjacent the ion injector, for example substantially at or near to the same Y position as the ion injector. In such embodiments the ion detector may be positioned, for example, within a distance (centre to centre) of 50 mm, or within 40 mm or within 30 mm or within 20 mm of the ion injector.

Preferably the ion detector is arranged to have a detection surface which is parallel to the drift direction Y, i.e. the detection surface is parallel to the Y axis. In some embodiments, the detector may have a degree of inclination to the Y direction, preferably by an amount to match the angle of the ion isochronous plane, for example a degree of inclination of 1 to 5 degrees, or 1 to 4 degrees, or 1 to 3 degrees. The detector may be located in the direction X at a position intermediate between the ion mirrors, e.g. centrally or halfway between the ion mirrors.

The multi-reflection mass spectrometer may form all or part of a multi-reflection time-of-flight mass spectrometer. In such embodiments of the invention, preferably the ion detector located in a region adjacent the ion injector is arranged to have a detection surface which is parallel to the drift direction Y, i.e. the detection surface is parallel to the Y axis. Preferably the ion detector is arranged so that ions that have traversed the mass spectrometer, moving forth and back between the mirrors along the drift direction as described herein, impinge upon the ion detection surface and are detected. The ions may undergo an integer or a non-integer number of complete oscillations K between the mirrors before impinging upon a detector. Advantageously, the ion detector detects all the ions after they have completed exactly the same number N of reflections between the ion mirrors.

The multi-reflection mass spectrometer may form all or part of a multi-reflection electrostatic trap mass spectrometer, as will be further described. In such embodiments of the invention, the detector preferably comprises one or more electrodes arranged to be close to the ion beam as it passes by, but located so as not to intercept it, the detection electrodes connected to a sensitive amplifier enabling the image current induced in the detection electrodes to be measured.

The ion mirrors may comprise any known type of elongated ion mirror. The ion mirrors are typically electrostatic ion mirrors. The mirrors may be gridded or the mirrors may be gridless. Preferably the mirrors are gridless. The ion mirrors are typically planar ion mirrors, especially electrostatic planar ion mirrors. In numerous embodiments, the planar ion mirrors are parallel to each other, for example over the majority or the entirety of their length in the drift direction Y. In some embodiments, the ion mirrors may not be parallel over a short length in the drift direction Y (e.g. at their entrance end closest to the ion injector as in US 2018-0138026 A). The mirrors are typically substantially the same length in the drift direction Y. The ion mirrors are preferably separated by a region of electric field free space.

The ion optical mirrors oppose one another. By opposing mirrors it is meant that the mirrors are oriented so that ions directed into a first mirror are reflected out of the first mirror towards a second mirror and ions entering the second mirror are reflected out of the second mirror towards the first mirror. The opposing mirrors therefore have components of electric field which are generally oriented in opposite directions and facing one another.

Each mirror is preferably made of a plurality of elongated parallel bar electrodes, the electrodes elongated generally in the direction Y. Such constructions of mirrors are known in the art, for example as described in SU172528 or US2015/0028197. The elongated electrodes of the ion mirrors may be provided as mounted metal bars or as metal tracks on a PCB base. The elongated electrodes may be made of a metal having a low coefficient of thermal expansion such as Invar such that the time of flight is resistant to changes in temperature within the instrument. The electrode shape of the ion mirrors can be precisely machined or obtained by wire erosion manufacturing.

The mirror length (total length of both first and second stages) is not particularly limited in the invention but preferred practical embodiments have a total length in the range 300-500 mm, more preferably 350-450 mm.

The multi-reflection mass spectrometer comprises two ion mirrors, each mirror elongated predominantly in one direction Y. The elongation may be linear (i.e. straight), or the elongation may be non-linear (e.g. curved or comprising a series of small steps so as to approximate a curve), as will be further described. The elongation shape of each mirror may be the same or it may be different. Preferably the elongation shape for each mirror is the same. Preferably the mirrors are a pair of symmetrical mirrors. Where the elongation is linear, the mirrors can be parallel to each other, although in some embodiments, the mirrors may not be parallel to each other.

As herein described, the two mirrors are aligned to one another so that they lie in the X-Y plane and so that the elongated dimensions of both mirrors lie generally in the drift direction Y. The mirrors are spaced apart and oppose one another in the X direction. The distance or gap between the ion mirrors can be conveniently arranged to be constant as a function of the drift distance, i.e. as a function of Y, the elongated dimension of the mirrors. In this way the ion mirrors are arranged parallel to each other. However, in some embodiments, the distance or gap between the mirrors can be arranged to vary as a function of the drift distance, i.e. as a function of Y, the elongated dimensions of both mirrors will not lie precisely in the Y direction and for this reason the mirrors are described as being elongated generally along the drift direction Y. Thus, being elongated generally along the drift direction Y can also be understood as being elongated primarily or substantially along the drift direction Y. In some embodiments of the invention the elongated dimension of at least one mirror may be at an angle to the direction Y for at least a portion of its length.

Herein, the distance between the opposing ion mirrors in the X direction means an effective distance in the X direction between the average turning points of ions within the mirrors. A precise definition of the effective distance W between the mirrors, which generally have a field-free region between them, is the product of the average ion velocity in the field-free region and the time lapse between two consecutive turning points, which is independent of the ion's mass-to-charge ratio. An average turning point of ions within a mirror herein means the maximum point or distance in the +/−X direction within the mirror that ions having average kinetic energy and average initial angular divergence characteristics reach, i.e. the point at which such ions are turned around in the X direction before proceeding back out of the mirror. Ions having a given kinetic energy in the +/−X direction are turned around at an equipotential surface within the mirror. The locus of such points at all positions along the drift direction Y of a particular mirror defines the turning points for that mirror, and the locus is hereinafter termed an average reflection surface. In both the description and claims, reference to the distance between the opposing ion-optical mirrors is intended to mean the distance between the opposing average reflection surfaces of the mirrors as just defined. In the present invention, immediately before the ions enter each of the opposing mirrors at any point along the elongated length of the mirrors they possess their original kinetic energy in the +/−X direction. The distance between the opposing ion mirrors may therefore also be defined as the distance between opposing equipotential surfaces where the nominal ions (those having average kinetic energy and average initial angular incidence) turn in the X direction, the said equipotential surfaces extending along the elongated length of the mirrors.

In the present invention, the mechanical construction of the mirrors themselves may appear, under superficial inspection, to maintain a constant distance apart in X as a function of Y, whilst the average reflection surfaces may actually be at differing distances apart in X as a function of Y. For example, one or more of the opposing ion mirrors may be formed from conductive tracks disposed upon an insulating former (such as a printed circuit board) and the former of one such mirror may be arranged a constant distance apart from an opposing mirror along the whole of the drift length whilst the conductive tracks disposed upon the former may not be a constant distance from electrodes in the opposing mirror. Even if electrodes of both mirrors are arranged a constant distance apart along the whole drift length, different electrodes may be biased with different electrical potentials within one or both mirrors along the drift lengths, causing the distance between the opposing average reflection surfaces of the mirrors to vary along the drift length. Thus, the distance between the opposing ion-optical mirrors in the X direction varies along at least a portion of the length of the mirrors in the drift direction.

Preferably, a distance between the opposing ion mirrors in the X direction is constant or varies smoothly as a function of the drift distance. In some embodiments of the present invention the variation in distance between the opposing ion mirrors in the X direction varies linearly as a function of the drift distance, or in two linear stages, i.e. the distance between the opposing ion-optical mirrors in the X direction varies as a first linear function of the drift distance for the first portion of the length and varies as a second linear function of the drift distance for the second portion of the length, the first linear function having a higher gradient than the second linear function (i.e. the distance between the opposing ion-optical mirrors in the X direction varying more greatly as a function of the drift distance for the first linear function than the second). In some embodiments of the present invention the variation in distance between the opposing ion-optical mirrors in the X direction varies non-linearly as a function of the drift distance.

The two elongated ion-optical mirrors may be similar to each other or they may differ. For example, one mirror may comprise a grid whilst the other may not; one mirror may comprise a curved portion whilst the other mirror may be straight. Preferably both mirrors are gridless and similar to each other. Most preferably the mirrors are gridless and symmetrical.

The mirror structures may be continuous in the drift direction Y, i.e. not sectioned, and this eliminates ion beam scattering associated with the step-wise change in the electric field in the gaps between such sections.

Advantageously, embodiments of the present invention may be constructed without the inclusion of any additional lenses or diaphragms in the region between the opposing ion optical mirrors. However additional lenses or diaphragms might be used with the present invention in order to affect the phase-space volume of ions within the mass spectrometer and embodiments are conceived comprising one or more lenses and diaphragms located in the space between the mirrors.

In some embodiments, the mass spectrometer of the present invention includes one or more compensation electrodes in the space between the mirrors to minimise the impact of time of flight aberrations caused by for example mirror misalignment. The compensation electrodes extend along at least a portion of the drift direction in or adjacent the space between the mirrors.

In some embodiments of the present invention, compensation electrodes are used with the opposing ion optical mirrors elongated generally along the drift direction. In some embodiments, the compensation electrodes are used in combination with non-parallel ion mirrors. In some embodiments, the compensation electrodes create components of electric field which oppose ion motion along the +Y direction along at least a portion of the ion optical mirror lengths in the drift direction. These components of electric field preferably provide or contribute to a returning force upon the ions as they move along the drift direction.

The one or more compensation electrodes may be of any shape and size relative to the mirrors of the multi-reflection mass spectrometer. In preferred embodiments the one or more compensation electrodes comprise extended surfaces parallel to the X-Y plane facing the ion beam, the electrodes being displaced in +/−Z from the ion beam flight path, i.e. each one or more electrodes preferably having a surface substantially parallel to the X-Y plane, and where there are two such electrodes, preferably being located either side of a space extending between the opposing mirrors. In another preferred embodiment, the one or more compensation electrodes are elongated in the Y direction along a substantial portion of the drift length, each electrode being located either side of the space extending between the opposing mirrors. In this embodiment preferably the one or more compensation electrodes are elongated in the Y direction along a substantial portion, the substantial portion being at least one or more of: 1/10; 1/5; 1/4; 1/3; 1/2; 3/4 of the total drift length. In some embodiments, the one or more compensation electrodes comprise two compensation electrodes elongated in the Y direction along a substantial portion of the drift length, the substantial portion being at least one or more of: 1/10; 1/5; 1/4; 1/3; 1/2; 3/4 of the total drift length, one electrode displaced in the +Z direction from the ion beam flight path, the other electrode displaced in the −Z direction from the ion beam flight path, the two electrodes thereby being located either side of a space extending between the opposing mirrors. However other geometries are anticipated. The one or more compensation electrodes can be elongated in the Y direction along substantially the first and second portions of the length along direction Y (i.e. along both stages of the different mirror convergence), or for example substantially along only the second portion of the length. Preferably, the compensation electrodes are electrically biased in use such that the total time of flight of ions is substantially independent of the incidence angle of the ions. As the total drift length travelled by the ions is dependent upon the incidence angle of the ions, the total time of flight of ions is substantially independent of the drift length travelled.

Compensation electrodes may be biased with an electrical potential. Where a pair of compensation electrodes is used, each electrode of the pair may have the same electrical potential applied to it, or the two electrodes may have differing electrical potentials applied. Preferably, where there are two electrodes, the electrodes are located symmetrically either side of a space extending between the opposing mirrors and the electrodes are both electrically biased with substantially equal potentials.

In some embodiments, one or more pairs of compensation electrodes may have each electrode in the pair biased with the same electrical potential and that electrical potential may be zero volts with respect to what is herein termed as an analyser reference potential. Typically the analyser reference potential will be ground potential, but it will be appreciated that the analyser may be arbitrarily raised in potential, i.e. the whole analyser may be floated up or down in potential with respect to ground. As used herein, zero potential or zero volts is used to denote a zero potential difference with respect to the analyser reference potential and the term non-zero potential is used to denote a non-zero potential difference with respect to the analyser reference potential. Typically the analyser reference potential is, for example, applied to shielding such as electrodes used to terminate mirrors, and as herein defined is the potential in the drift space between the opposing ion optical mirrors in the absence of all other electrodes besides those comprising the mirrors.

In preferred embodiments, two or more pairs of opposing compensation electrodes are provided. In such embodiments, some pairs of compensation electrodes in which each electrode is electrically biased with zero volts are further referred to as unbiased compensation electrodes, and other pairs of compensation electrodes having non-zero electric potentials applied are further referred to as biased compensation electrodes. Typically the unbiased compensation electrodes terminate the fields from biased compensation electrodes. In one embodiment, surfaces of at least one pair of compensation electrodes have a profile in the X-Y plane, such that the said surfaces extend towards each mirror a greater distance in the regions near one or both the ends of the mirrors than in the central region between the ends. In another embodiment, at least one pair of compensation electrodes have surfaces having a profile in the X-Y plane, such that the said surfaces extend towards each mirror a lesser distance in the regions near one or both the ends of the mirrors than in the central region between the ends. In such embodiments preferably the pair(s) of compensation electrodes extend along the drift direction Y from a region adjacent an ion injector at one end of the elongated mirrors, and the compensation electrodes are substantially the same length in the drift direction as the extended mirrors, and are located either side of a space between the mirrors. In alternative embodiments, the compensation electrode surfaces as just described may be made up of multiple discrete electrodes.

Preferably, in all embodiments of the present invention, the compensation electrodes do not comprise ion optical mirrors in which the ion beam encounters a potential barrier at least as large as the kinetic energy of the ions in the drift direction. However, as has already been stated and will be further described, they preferably create components of electric field which oppose ion motion along the +Y direction along at least a portion of the ion optical mirror lengths in the drift direction.

Preferably the one or more compensation electrodes are, in use, electrically biased so as to compensate for at least some of the time-of-flight aberrations generated by the opposing mirrors. Where there is more than one compensation electrode, the compensation electrodes may be biased with the same electrical potential, or they may be biased with different electrical potentials. Where there is more than one compensation electrode one or more of the compensation electrodes may be biased with a non-zero electrical potential whilst other compensation electrodes may be held at another electrical potential, which may be zero potential. In use, some compensation electrodes may serve the purpose of limiting the spatial extent of the electric field of other compensation electrodes.

In some embodiments, one or more compensation electrodes may comprise a plate coated with an electrically resistive material which has different electrical potentials applied to it at different ends of the plate in the Y direction, thereby creating an electrode having a surface with a varying electrical potential across it as a function of the drift direction Y. Accordingly, electrically biased compensation electrodes may be held at no one single potential. Preferably the one or more compensation electrodes are, in use, electrically biased so as to compensate for a time-of-flight shift in the drift direction generated by misalignment or manufacturing tolerances of the opposing mirrors and so as to make a total time-of-flight shift of the system substantially independent of such misalignment or manufacturing.

The electrical potentials applied to compensation electrodes may be held constant or may be varied in time. Preferably the potentials applied to the compensation electrodes are held constant in time whilst ions propagate through the multi-reflection mass spectrometer. The electrical bias applied to the compensation electrodes may be such as to cause ions passing in the vicinity of a compensation electrode so biased to decelerate, or to accelerate, the shapes of the compensation electrodes differing accordingly, examples of which will be further described. As herein described, the term "width" as applied to compensation electrodes refers to the physical dimension of the biased compensation electrode in the +/−X direction. It will be appreciated that potentials (i.e. electric potentials) and electric fields provided by the ion mirrors and/or potentials and electric fields provided by the compensation electrodes are present when the ion mirrors and/or compensation electrodes respectively are electrically biased.

The biased compensation electrodes located adjacent or in the space between the ion mirrors can be positioned between two or more unbiased (grounded) electrodes in the X-Y plane that are also located adjacent or in the space between the ion mirrors. The shapes of the unbiased electrodes can be complementary to the shape of the biased compensation electrodes.

In some preferred embodiments, the space between the opposing ion optical mirrors is open ended in the X-Z plane at each end of the drift length. By open ended in the X-Z plane it is meant that the mirrors are not bounded by electrodes in the X-Z plane which fully or substantially span the gap between the mirrors.

Embodiments of the multi-reflection mass spectrometer of the present invention may form all or part of a multi-reflection electrostatic trap mass spectrometer. A preferred electrostatic trap mass spectrometer comprises two multi-reflection mass spectrometers arranged end to end symmetrically about an X axis such that their respective drift directions are collinear, the multi-reflection mass spectrometers thereby defining a volume within which, in use, ions follow a closed path with isochronous properties in both the drift directions and in an ion flight direction. Such systems are described in US2015/0028197 and shown in FIG. 13 of that document, the disclosure of which is hereby incorporated by reference in its entirety (however, where anything in the incorporated reference contradicts anything stated in the present application, the present application prevails). A plurality of pairs (e.g. four pairs in the case of two multi-reflection mass spectrometers arranged end to end) of stripe-shaped detection electrodes can be used for readout of an induced-current signal on every pass of the ions between the mirrors. The electrodes in each pair are symmetrically separated in the Z-direction and can be located in the planes of compensation electrodes or closer to the ion beam. The electrode pairs are connected to the direct input of a differential amplifier and the electrode pairs are connected to the inverse input of the differential amplifier, thus providing differential induced-current signal, which advantageously reduces the noise. To obtain the mass spectrum, the induced-current signal is processed in known ways using the Fourier transform algorithms or specialized comb-sampling algorithm, as described by J. B. Greenwood at al. in Rev. Sci. Instr. 82, 043103 (2011).

The multi-reflection mass spectrometer of the present invention may form all or part of a multi-reflection time-of-flight mass spectrometer.

A composite mass spectrometer may be formed comprising two or more multi-reflection mass spectrometers according to the invention aligned so that the X-Y planes of each mass spectrometer are parallel and optionally displaced from one another in a perpendicular direction Z, the composite mass spectrometer further comprising ion-optical means to direct ions from one multi-reflection mass spectrometer to another. In one such embodiment of a composite mass spectrometer a set of multi-reflection mass spectrometers are stacked one upon another in the Z direction and ions are passed from a first multi-reflection mass spectrometer in the stack to further multi-reflection mass spectrometers in the stack by means of deflection means, such as electrostatic electrode deflectors, thereby providing an extended flight path composite mass spectrometer in which ions do not follow the same path more than once, allowing full mass range TOF analysis as there is no overlap of ions. Such systems are described in US2015/0028197 and shown in FIG. 14 of that document. In another such embodiment of a composite mass spectrometer a set of multi-reflection mass spectrometers are each arranged to lie in the same X-Y plane and ions are passed from a first multi-reflection mass spectrometer to further multi-reflection mass spectrometers by means of deflection means, such as electrostatic electrode deflectors, thereby providing an extended flight path composite mass spectrometer in which ions do not follow the same path more than once, allowing full mass range TOF analysis as there is no overlap of ions. Other arrangements of multi-reflection mass spectrometers are envisaged in which some of the spectrometers lie in the same X-Y plane and others are displaced in the perpendicular Z direction, with ion-optical means arranged to pass ions from spectrometer to another thereby providing an extended flight path composite mass spectrometer in which ions do not follow the same path more than once. Preferably, where some spectrometers are stacked in Z direction, the said spectrometers have alternating orientations of the drift directions to avoid the requirement for deflection means in the drift direction.

Alternatively, embodiments of the present invention may be used with a further beam deflection means arranged to turn ions around and pass them back through the multi-reflection mass spectrometer or composite mass spectrometer one or more times, thereby multiplying the flight path length, though at the expense of mass range.

Analysis systems for MS/MS may be provided using the present invention comprising a multi-reflection mass spectrometer and, an ion injector comprising an ion trapping device upstream of the mass spectrometer, and a pulsed ion gate, a high energy collision cell and a time-of-flight analyser downstream of the mass spectrometer. Such systems are described in US2015/0028197 and shown in FIG. 15 of that document. Moreover, the same analyser could be used for both stages of analysis or multiple such stages of analysis thereby providing the capability of MSn, by configuring the collision cell so that ions emerging from the collision cell are directed back into the ion trapping device.

As a result of time-of-flight focussing in both X and Y directions, the ions arrive at substantially same coordinate in the Y direction at the detector after a designated number of oscillations between the mirrors in X direction. Spatial focussing on the detector is thereby achieved and the mass spectrometer construction is greatly simplified.

DETAILED DESCRIPTION OF EMBODIMENTS OF THE INVENTION

Various embodiments of the invention will now be described with reference to the figures. These embodiments are intended to illustrate features of the invention and are not intended to be limiting on the scope of the invention. It will be appreciated that variations to the embodiments can be made while still falling within the scope of the invention as defined by the claims.

Figure 5:
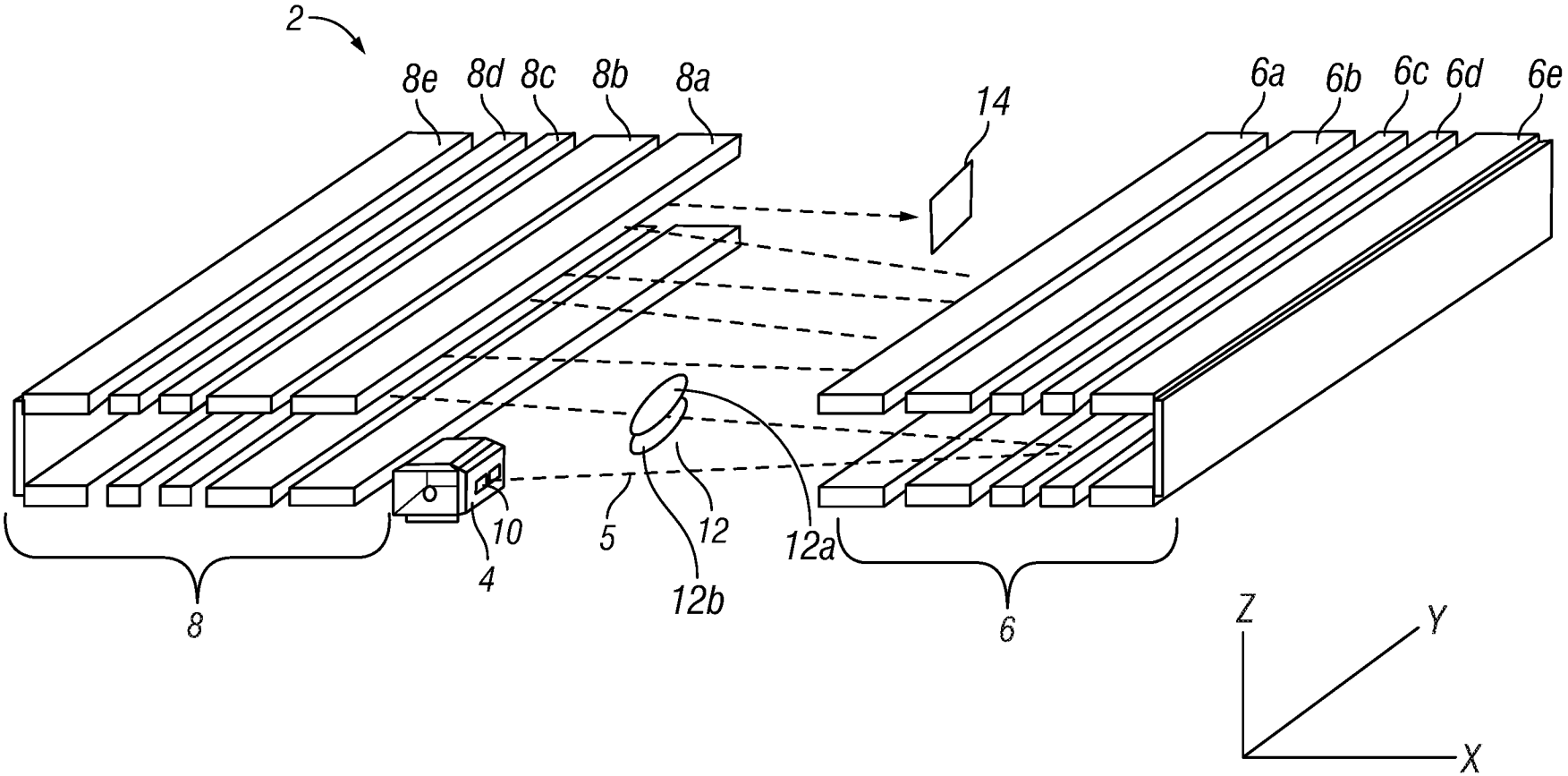
FIG. 5 shows schematically a multi-reflection mass spectrometer according to an embodiment of the present invention.

A multi-reflection mass spectrometer 2 according to an embodiment of the present invention is shown in FIG. 5. Ions generated from an ion source (e.g. ESI or other source), which is not shown, are accumulated in a pulsed ion injector, in this embodiment in the form of ion trap 4. In this case, the ion trap is a linear ion trap, such as a rectilinear ion trap (R-Trap) or a curved linear ion trap (C-trap) for example. An ion beam 5 is formed by extracting a packet of trapped thermalized ions, which has for example less than 0.5 mm width in the drift direction Y, from the linear ion trap 4 and injecting it at high energy (in this embodiment 4 kV) into the space between two opposing parallel mirrors 6, 8 by applying an appropriate accelerating/extraction voltage to electrodes of the ion trap 4 (e.g. pull/push electrodes). Ions exit the ion trap via the slot 10 in the ion trap 4. The ion beam enters the first mirror 6 and is focused in the out-of-plane dimension by lensing effected by the first electrode pair 6*a* of the mirror 6, and reflected to a time focus by the remaining electrodes 6*b*-6*e* of the mirror. In this example, the available space between mirrors (i.e. the distance in direction X between the first electrodes (6*a*, 8*a*) of each mirror) is 300 mm and the total effective width of the analyser (i.e. the effective distance in the X direction between the average turning points of ions within the mirrors) is ~650 mm. The total length (i.e. in direction Y) is 550 mm to form a reasonably compact analyser.

Figure 6:
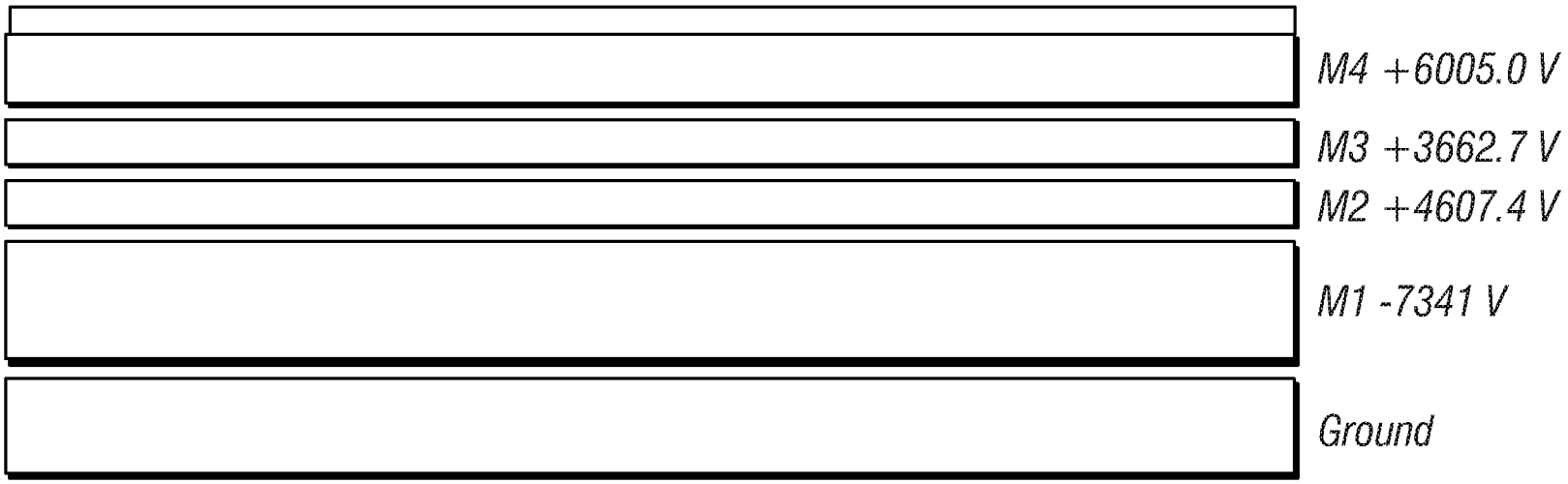
FIG. 6 shows schematically an ion mirror electrode configuration and applied voltages.

Suitable ion mirrors such as 6 and 8 are well understood from the prior art (e.g. U.S. Pat. No. 9,136,101). An example configuration of ion mirror, like that shown in FIG. 5, is a mirror that comprises a plurality of pairs of elongated electrodes spaced apart in the X direction, such as five pairs of elongated electrodes, the first electrode pair (6*a*, 8*a*) of the mirror being set to ground potential. In each pair, there is one electrode positioned above the ion beam and one electrode below the beam (in Z direction shown). Example of voltages for the set of electrodes (6*a*-6*e*, 8*a*-8*e*) in order to provide a reflecting potential with a time focus for ions is shown in FIG. 6 with applied voltages being suitable for focusing 4 keV positive ions. For negative ions the polarities can be reversed.

After the first reflection in the first ion mirror 6, the ion beam expands substantially under thermal drift to about 8 mm in width in the drift direction and meets an ion focusing arrangement in the form of a drift focusing lens 12, which focuses the ion beam in the drift direction Y. The drift focusing lens 12 is located in the direction X centrally in the space between the mirrors, i.e. halfway between the mirrors. The drift focusing lens 12 in this embodiment is a trans-axial lens comprising a pair of opposing lens electrodes positioned either side of the beam in a direction Z (perpendicular to directions X and Y). Specifically, the drift focusing lens 12 comprises a pair of quasi-elliptical plates 12*a*, 12*b* located above and below the ion beam. The lens may be referred to as a button-shaped lens. In this embodiment, the plates are 7 mm wide and 24 mm long with about −100V applied. In some embodiments, the pair of opposing lens electrodes may comprise circular, elliptical, quasi-elliptical or arc-shaped electrodes. The drift focusing lens 12 has a converging effect on the ion beam by reducing an angular spread of the ions in the drift direction Y.

After focusing by the focusing lens 12, the ion beam 5 proceeds to undergo multiple further reflections between the ion mirrors in the direction X whilst drifting along the drift direction Y so as to follow a zigzag ion path in the X-Y plane between the ion mirrors (there being a total of N mirror reflections in the system). After completing N reflections (i.e. N/2 "oscillations", where an oscillation is equal to twice the distance between consecutive reflections in the direction X), the ions are detected by an ion detector 14 to permit the time of flight of the ions to be detected. A data acquisition system comprising a processor (not shown) is interfaced to the detector and enables a mass spectrum to be produced. In the embodiment shown, the ions undergo 22 reflections (N=22), giving a total flight path of more than 10 metres. The detector is preferably a fast time response detector such as a multi-channel plate (MCP) or dynode electron multiplier with magnetic and electric fields for electron focusing.

Important factors for the positioning of the drift focusing lens 12 have been determined. Firstly, the ion beam should preferably have expanded sufficiently so that by the time it reaches the focusing lens the effect of the lens on the drift energy or angular spread is maximised relative to its effect on the spatial spread. This means that the ion beam must be allowed to expand before it reaches the drift focusing lens. Thus, it is preferable to position the lens after the first reflection in the ion mirror 6 (unless the mirror separation is very large, for example 500 mm). Secondly, for an injection of an ion beam at a 2 degree inclination angle to the direction X into a mass spectrometer system of this size, the reflections of the central ion trajectory (i.e. centre of the ion beam) are separated by less than 25 mm, and it is important that the focusing lens not be so large as to interfere with adjacent ion trajectories. Without drift focusing, the ion beam would be already 20 mm wide by the third reflection and by the fourth reflection trajectories nearly start to overlap with those of other reflections. The optimum position for the drift focusing lens is therefore preferably after the first but before the fourth or fifth reflection in the system, i.e. it is positioned relatively early in a system such as this, which has a total of 22 reflections (N=22). The optimum position for the drift focusing lens is preferably before the reflection with a number less than 0.25N or less than 0.2N. The optimum position for the drift focusing lens is more preferably after the first reflection but before the second or third reflection (especially before the second).

The concept of placing button shaped electrodes (e.g. circular, oval, elliptical or quasi-elliptical) above and below the ion beam to generate drift focusing in a multi-turn ToF instrument, albeit in a periodic manner and constructed within an orbital geometry, is described in US 2014/175274 A, the contents of which is hereby incorporated by reference in its entirety. Such lenses are a form of "transaxial lens" (see P. W Hawkes and E Kasper, *Principles of Electron Optics Volume* 2, Academic Press, London, 1989, the contents of which is hereby incorporated by reference in its entirety). Such lenses have an advantage of having a wide spatial acceptance, which is important to control such an elongated ion beam. The lenses need to be wide enough to both accommodate the ion beam and so that the 3D field perturbation from the sides of the lens does not damage the focal properties. The space between the lenses should likewise be a compromise between minimising these 3D perturbations and accommodating the height of the beam. In practice, a distance of 4-8 mm can be sufficient.

A variation in lens curvature from a circular (button) lens to a narrow ellipse shaped lens is possible. A quasi-elliptical structure taking a short arc reduces the time-of-flight aberrations compared to a wider arc or full circle as the path through it is shorter but it requires stronger voltages and at extremes will start to induce considerable lensing out-of-plane. This effect may be harnessed for some combination of control of drift and out-of-plane dispersion in a single lens, but will limit the range of control over each property. As an adjunct, areas where strong fields are already applied, such as the ion extraction region at the ion trap 4, may be exploited via curvature of the ion trap pull/push electrodes to either induce or limit drift divergence of the ion beam. An example of this is the commercial Curved Linear Ion Trap (C-trap) described in US 2011-284737 A, the contents of which is hereby incorporated by reference in its entirety, where an elongated ion beam is focused to a point to aid injection into an Orbitrap™ mass analyser.

Figure 7B:
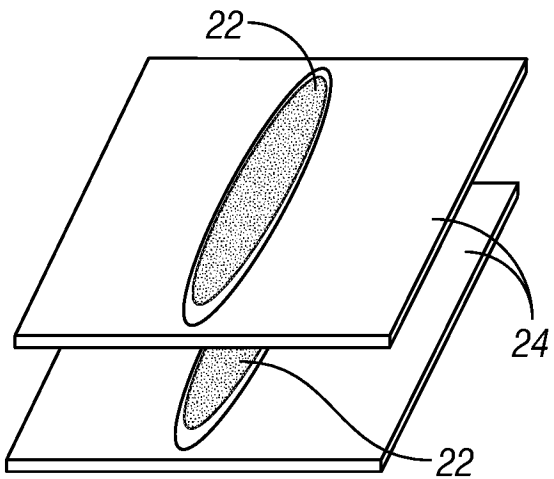
FIG. 7B shows schematically shaped drift focusing lenses having elliptical shapes.
Figure 7A:
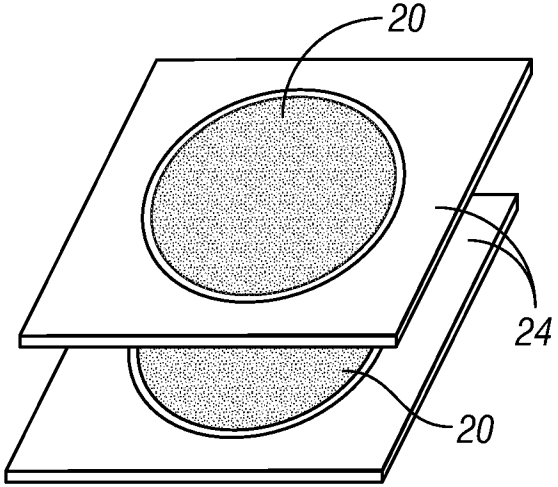
FIG. 7A shows schematically shaped drift focusing lenses having circular shape.
Figure 7C:
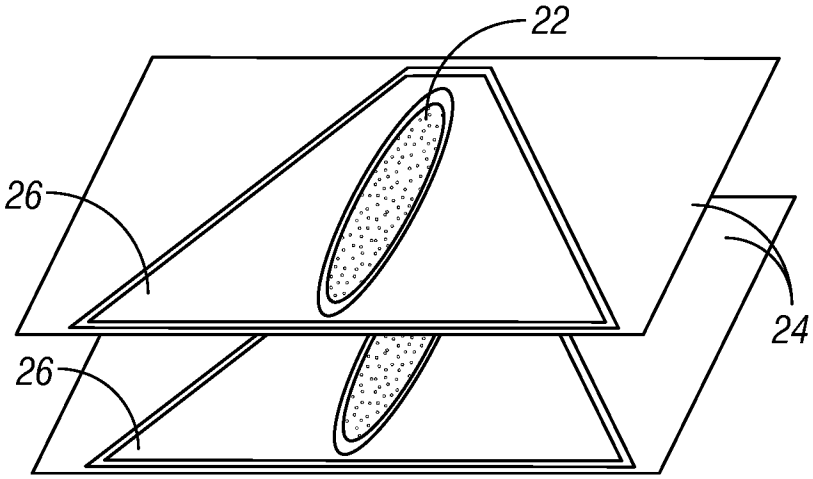
FIG. 7C shows a lens integrated into a prism-like deflector.
Figure 8B:
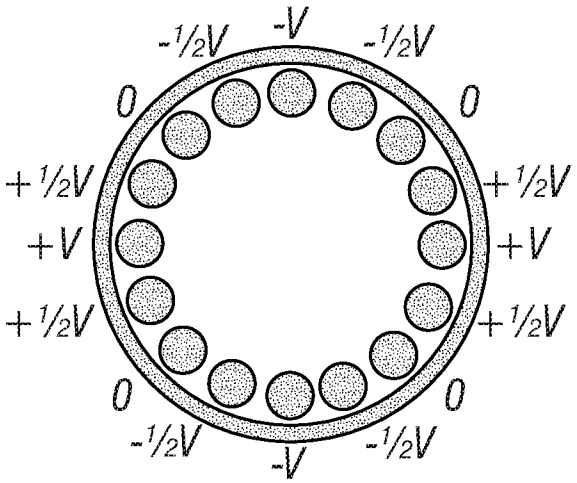
FIGS. 8A, 8B, and 8C schematically alternative structures for drift focusing lenses.
Figure 8C:
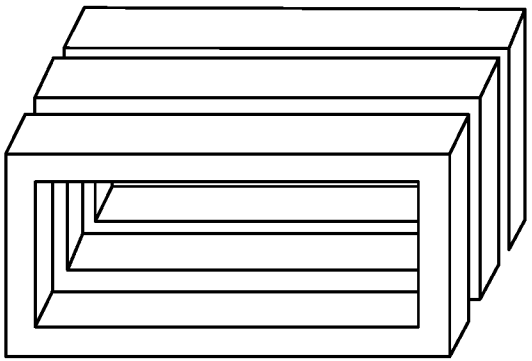
Figure 8A:
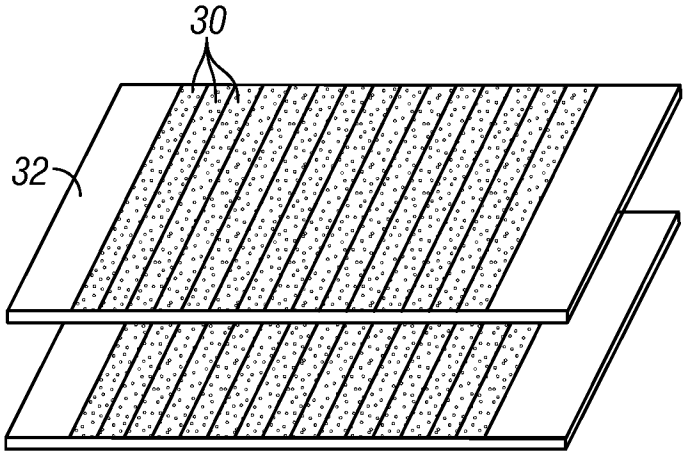

FIG. 7 shows different embodiments (A, B) of drift focusing lenses comprising circular 20 and quasi-elliptical 22 lens plates (electrodes) along with grounded surrounding electrodes 24 for each plate. The lens electrodes 20, 22 are insulated from the grounded surrounding electrodes 24. Also shown (C) is the integration of a lens 22 (in this case of the quasi-elliptical shape but could be circular etc.) into a deflector, which in this embodiment comprises a trapezoid shaped, prism-like electrode structure 26 arranged above and below the ion beam that serves as a deflector by presenting the incoming ions with a constant field angle rather than a curve. The deflector structure comprises a trapezoid shaped or prism-like electrode arranged above the ion beam and another trapezoid shaped or prism-like electrode arranged below the ion beam. The lens electrodes 22 are insulated from the deflector, i.e. trapezoid shaped, prism-like electrodes, in which they are located, which in turn is insulated from the grounded surrounding electrodes 24. Placement of the lens within a wide spatial acceptance deflector structure is a more space efficient design. Other possible embodiments of suitable lens are shown in FIG. 8, for example: an array (A) of mounted electrodes 30 (e.g. mounted on a printed circuit board (PCB) 32) separated by a resistor chain to mimic the field curvature created by shaped electrodes; a multipole rod assembly (B) to create a quadrupole or pseudo-quadrupole field, such as a 12-rod based lens having pseudo-quadrupole configuration with relative rod voltages (V) shown; and a aperture-based lens, such as a normal aperture Einzel-lens structure (C). Such embodiments of drift focusing lens, e.g. as shown in FIGS. 7 and 8, may be applicable to all embodiments of the multi-reflection mass spectrometer.

Figure 9:
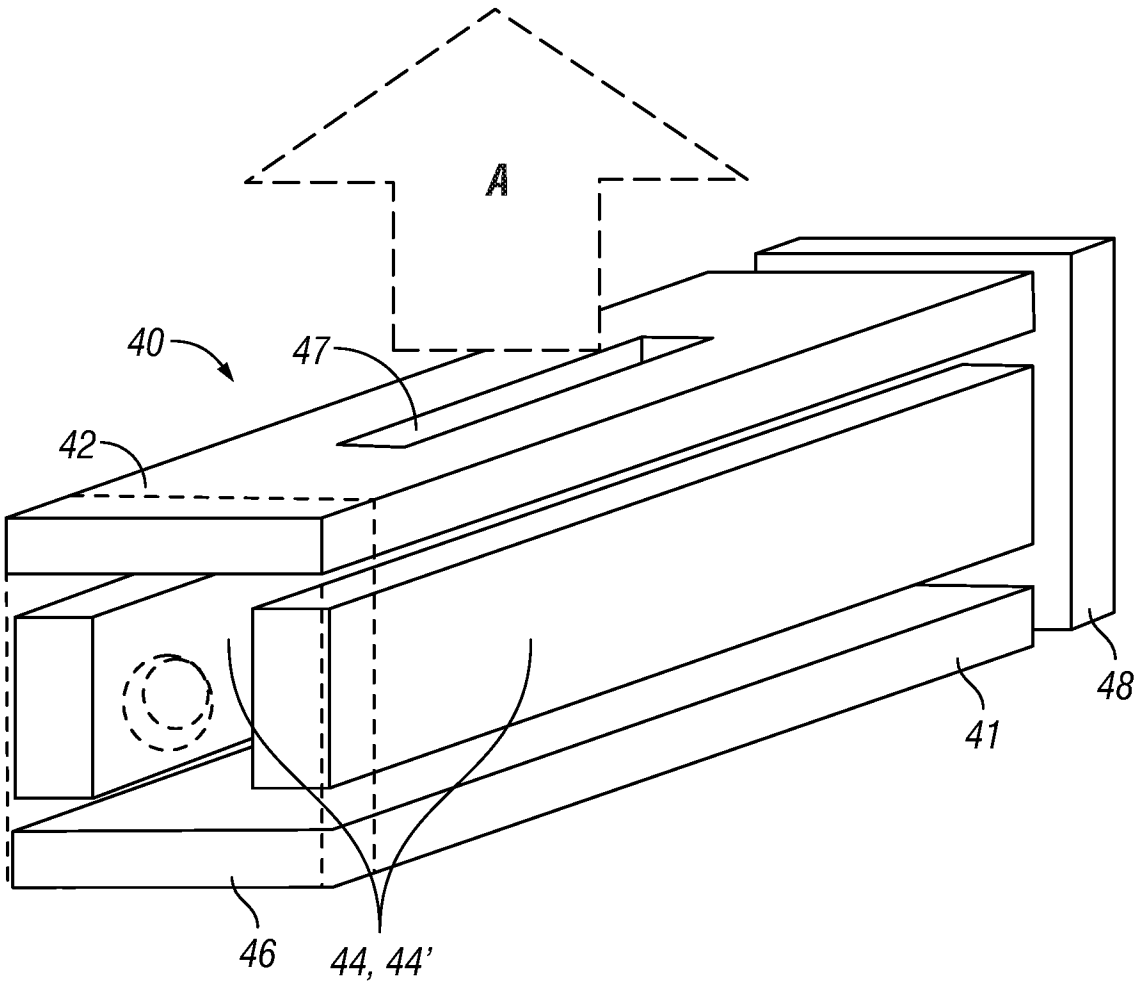
FIG. 9 shows schematically an embodiment of an extraction ion trap.

An extraction ion trap 40 suitable for use as the ion trap 4 is shown in FIG. 9. This is a linear quadrupole ion trap, which may receive ions generated by an ion source (not shown) and delivered by an interfacing ion optical arrangement (e.g. comprising one or more ion guides and the like) as well understood in the art. The ion trap 4 is composed of a multipole (quadruple) electrode set. The inscribed radius is 2 mm. Ions are radially confined by opposing RF voltages (1000V at 4 MHz) applied to respective opposite pairs 41, 42 and 44, 44' of the multipole electrodes; and axially confined by a small DC voltage (+5V) on the DC aperture electrodes (46, 48). Ions introduced into the ion trap 4 are thermalized by collisional cooling with background gas present in the ion trap ($<5\times10^{-3}$ mbar). Before extraction of the cooled ions into the ion mirrors of the mass analyser, the trap potential is raised to 4 kV and then an extraction field is applied by applying−1000V to the pull electrode 42 and +1000V to the push electrode (41), causing positive ions to be expelled through a slot (47) in the pull electrode into the analyser in the direction shown by the arrow A. Alternatively, the rectilinear quadrupole ion trap shown could be replaced by a curved linear ion trap (C-trap).

Figure 10:
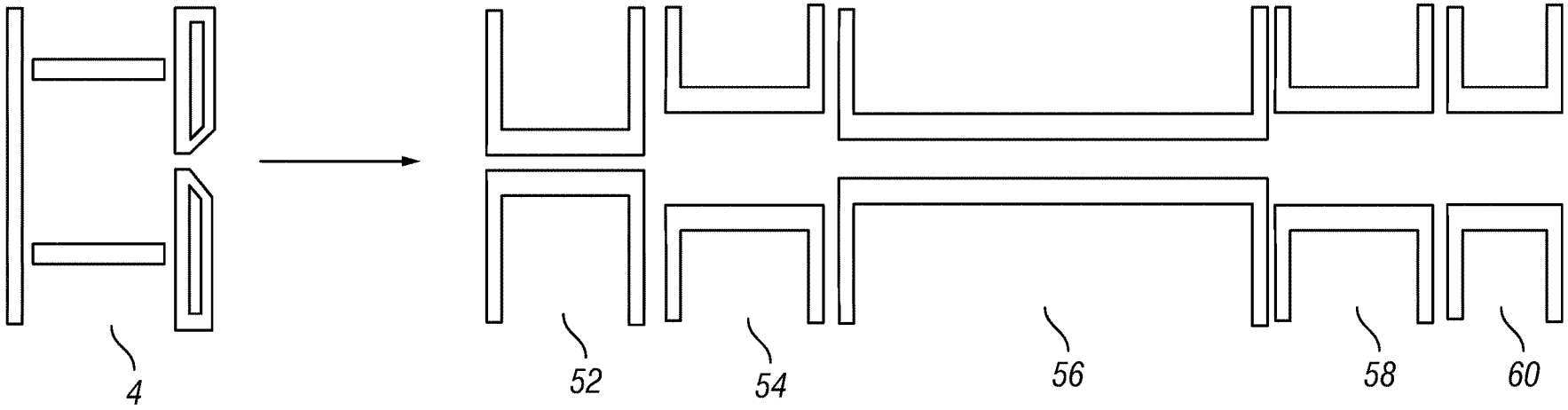
FIG. 10 shows schematically an embodiment of an injection optics scheme.

In addition to the ion trap 4, 40, it is preferred to have several further ion optical elements to control the injection of ions into the analyser ("injection optics"). Such ion injection optics may be considered part of the ion focusing arrangement. Firstly, it is beneficial to have out of plane focusing lenses (i.e. focusing in a direction out of the X-Y plane, i.e. in the direction Z) along the path between the ion trap 4 and the first mirror 6. Such out of plane focusing lenses can comprise elongated apertures that improve the transmission of ions into the mirror. Secondly, a portion, e.g. half, of the injection angle of the ion beam to the X direction as it enters the mirror can be provided by the angle of the ion trap to the X direction, and the remainder, e.g. the other half, can be provided by at least one deflector located in front of the ion trap (a so-called injection deflector). The injection deflector is generally positioned before the first reflection in the ion mirrors. The injection deflector can comprises at least one injection deflector electrode (e.g. a pair of electrodes positioned above and below the ion beam). In this way, the isochronous plane of the ions will be correctly aligned to the analyser rather than being 2 degrees misaligned with corresponding time-of-flight errors. Such a method is detailed in U.S. Pat. No. 9,136,101. The injection deflector may be a prism type deflector of the types shown in FIG. 7, with or without incorporating a drift focusing lens as shown in FIG. 7. In such embodiments, the injection deflector (e.g. prism type) for setting the injection angle can be provided in addition to a deflector (e.g. prism type) that can be mounted with or adjacent the drift focusing lens 12 after the first reflection in the ion mirror. In some embodiments, all or a major portion of the injection angle can be provided by an injection deflector. In addition, it will be appreciated that more than one injection deflector can be used (e.g. in series) to achieve a required injection angle (i.e. it can be seen that the system can include at least one injection deflector electrode, optionally two or more injection deflector electrodes). An example embodiment of an injection optics scheme is shown schematically in FIG. 10, along with suitable applied voltages. The ion trap 4 is a linear ion trap, to which the above described +1000V push and −1000V pull voltages are applied to the 4 kV trap to extract the ion beam. The beam then passes though in sequence ion optics comprising a ground electrode 52, first lens 54 held at +1800V, deflector 56 (+70V) of prism type with integrated elliptical lens (+750 V), second lens 58 held at +1200V and finally a ground electrode 60. The first and second lenses 54, 58 are apertured lenses (rectangular Einzel lenses) for providing out of plane focusing. The deflector 56 provides an inclination angle of the ion beam to the X-axis and the integrated elliptical lens can provide for controlled ion beam divergence in the drift direction Y.

It has been found that this additional drift focusing lens, mounted between the extraction ion trap 4 (or optionally incorporated into the ion trap itself by utilising for example a curved pull/adjacent ground electrode) and the first reflection and operated in a diverging manner is beneficial as it allows control of the ion beam divergence before the beam reaches the converging lens 12. Even more beneficially, the additional drift focusing lens mounted between the extraction ion trap 4 and the first reflection can be mounted within an injection deflector as described above and shown in the injection optics scheme of FIG. 10. In certain embodiments, therefore, the ion focusing arrangement can comprise a first drift focusing lens positioned before the first reflection in the ion mirrors for focusing the ion beam in the drift direction Y, wherein the first drift focusing lens is a diverging lens, and a second drift focusing lens positioned after the first reflection in the ion mirrors for focusing the ion beam in the drift direction Y, wherein the second drift focusing lens is a converging lens. The diverging drift focusing lens can be constructed as for the converging lens, e.g. as a trans-axial lens with circular, elliptical or quasi-elliptical shape, such as shown in FIG. 7, or as one of the other types of lens shown in FIG. 8. However, diverging drift focusing lens will have a different voltage applied to the converging drift focusing lens and acts on a different width of ion beam so as to provide different focusing properties to the converging drift focusing lens.

It is preferable that the converging drift focusing lens 12, mounted after the first reflection, also incorporates an ion deflector, e.g. the prism type shown in FIG. 7 (embodiment C). This deflector can be tuned to adjust the injection angle to a desired level and/or to correct for any beam deflection imposed by mechanical deviations in the mirrors. Furthermore, errors in mirror manufacture or mounting can induce a small time-of-flight error with every reflection, as ions on one side of the beam see a shorter flight path than the other, and these can preferably corrected by the addition of two compensation electrodes within the space between the mirrors as described above.

In U.S. Pat. No. 9,136,101, elongate electrodes (termed therein "compensation electrodes") with a low voltage (e.g. ~20V) are used to correct the time-of-flight error caused by the many hundreds of microns of mirror convergence. Similar electrodes, following linear or curved or even complex functions can be used in the present invention to correct for small misalignments or curvature of the mirror electrodes. One or more sets of compensation electrodes can be used wherein each set comprises a pair of elongate electrodes, one electrode positioned above the ion beam and one electrode positioned below the ion beam. The sets of compensation electrodes preferably extend for most of the length of the ion mirrors in the drift direction Y. Whilst such compensation electrodes can be considered for many error functions, the primary mechanical errors are likely to be non-parallelism of mirror electrodes and curvature around the centre, thus two sets of compensation electrodes should be sufficient, preferably each set of compensation electrodes having a different profile in the X-Y plane, e.g. one set having a profile in the X-Y plane that follows a linear function and one set with a profile in the X-Y plane that follows a curved function. The two sets of compensation electrodes are preferably placed side-by-side in the space between the ion mirrors. A set having a profile in the X-Y plane that follows a linear function, when biased, can correct for mirror tilt or misalignment. A set having a profile in the X-Y plane that follows a curved function, when biased, can correct for mirror curvature. The only disadvantage is that such compensation electrodes may add to any unwanted deflection of the ion beam, which can then be corrected by an appropriate voltage on the deflector, i.e. the deflector positioned between the mirrors after the first reflection.

Figure 11:
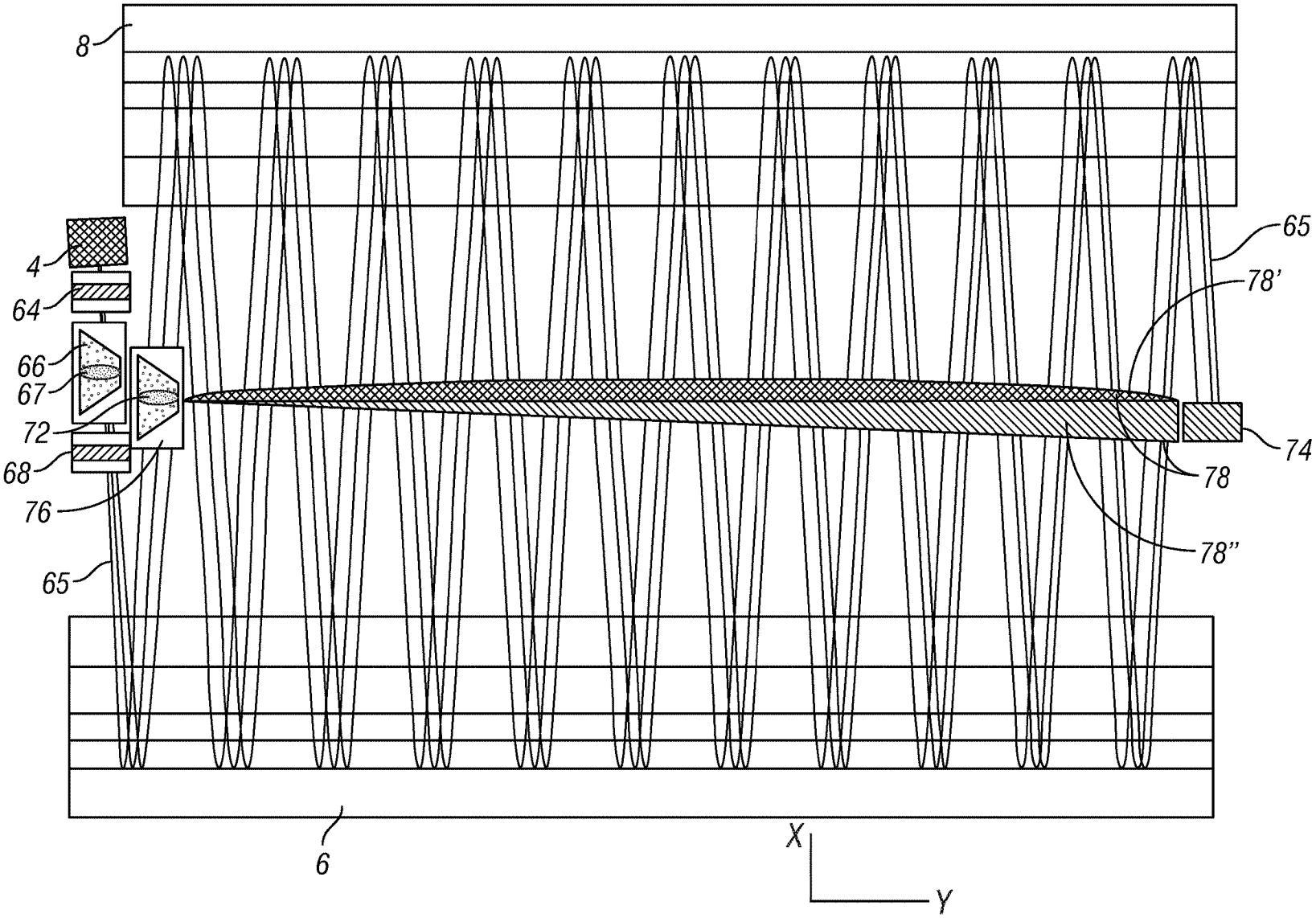
FIG. 11 shows schematically a multi-reflection mass spectrometer according to another embodiment of the present invention.
Figure 12B:
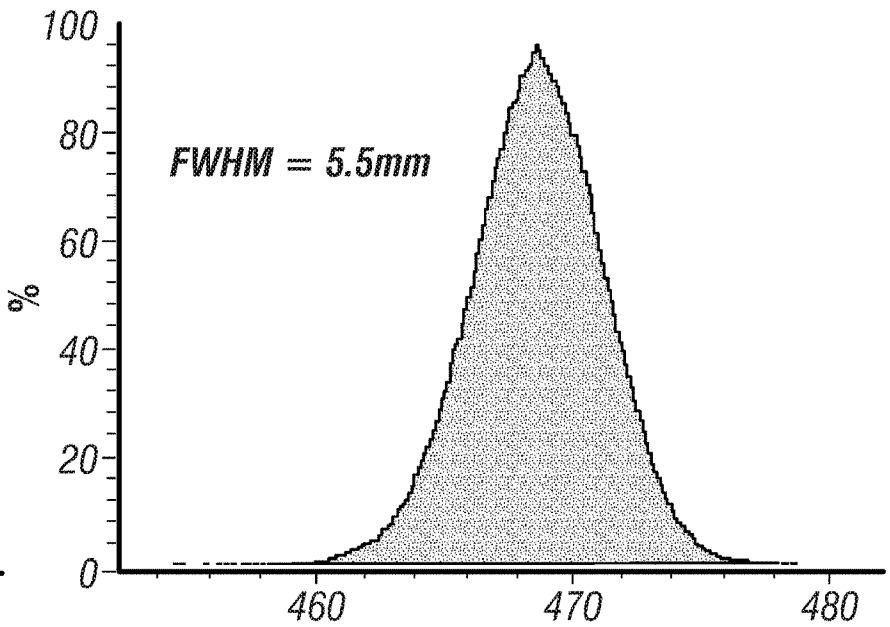
FIG. 12B shows drift spatial distribution of an initial 2 mm wide thermal ion packet at the detector using the system mass spectrometer in FIG. 11.
Figure 12A:
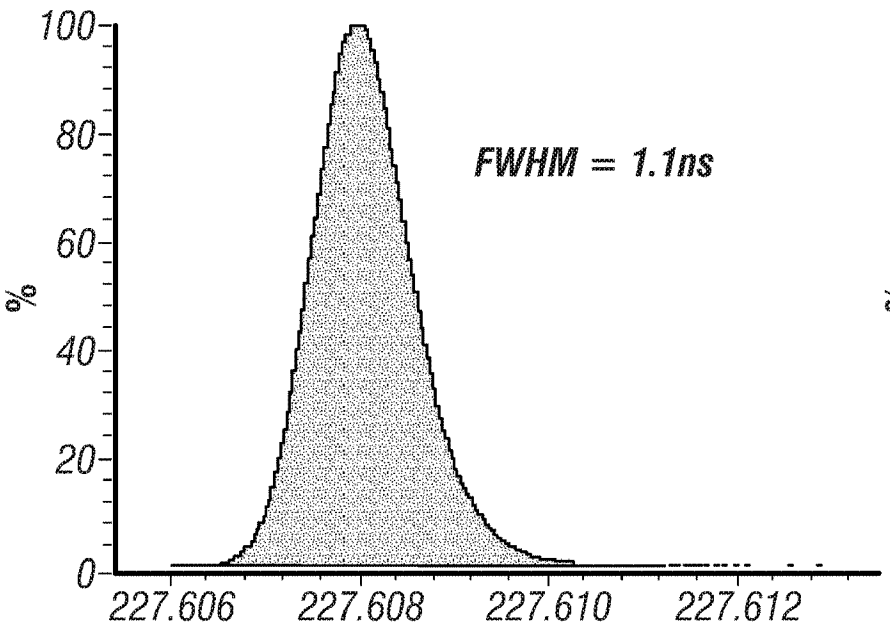
FIG. 12A shows simulated arrival time of an initial 2 mm wide thermal ion packet at the detector using the system mass spectrometer in FIG. 11.

An example of a preferred embodiment, comprising ion injection optics, drift focusing lenses and deflectors, and compensation electrodes is shown schematically in FIG. 11. This embodiment shows the simulated trajectories 65 of ions encompassing the typical range of thermal energies. An extraction ion trap 4 is shown for injecting an ion beam represented by the ion trajectories 65 between parallel elongate ion mirrors 6 and 8 of the type shown in FIGS. 5 and 6. The ion beam is injected generally in the X direction but with a small, 2 degrees, inclination angle to the X axis direction, i.e. with a velocity component in the drift direction Y. In this way, a zigzag trajectory path through the analyser is achieved. The ion beam first passes through injection optics, the injection optics comprising first lens 64 for out of plane focusing, deflector 66 of the above described prism type having an integrated elliptical drift focusing lens 67 mounted therein and second lens 68 for out of plane focusing. The drift focusing lens 67 is preferably a diverging lens. The beam diverges in the drift direction Y as it leaves the ion injector (ion trap) 4 as it travels towards the first mirror 6. The drift focusing lens 67 can provide further desired divergence. The ions undergo the first of N reflections in the first mirror 6 and are thereby reflected back towards the second ion mirror 8. The diverging ion beam encounters a drift focusing lens 72. The drift focusing lens 72 in this embodiment is located after the first reflection in the ion mirrors and before the second reflection (i.e. a reflection in the second ion mirror 8). The lens 72 is an elliptical drift focusing lens as described above mounted within a deflector 76 of the above described prism type. While the first drift focusing lens 67 is a diverging lens (to diverge the width of the beam in the drift direction Y), the second drift focusing lens 72 is a converging lens (to converge the width of the beam in the drift direction Y). The ion focusing arrangement of the drift focusing lens 72 provides long focusing of the ion beam in the drift direction Y, such that a spatial spread of the ion beam in the drift direction Y passes through a single minimum at or immediately after a reflection having a number between 0.25N and 0.75N, preferably approximately half-way between the first reflection and reflection N. Thus, the ion beam passes through a single minimum that is preferably substantially halfway along the ion path between the ion focusing lens 72 and the detector 74. Two sets of compensation electrodes 78 (one set of curved shape 78' and one set of linear shape 78") are provided in the shown embodiment to correct for any unwanted beam deflections of the ion beam as it undergoes its zigzag path, for example caused by mechanical or alignment deviations or unwanted curvature in the mirror construction. The two sets of compensation electrodes 78 are positioned side-by-side, although not in electrical contact, i.e. the sets are displaced from each other in the direction X. The set of curved shaped compensation electrodes 78' comprises a pair of elongate electrodes having a curved profile in the X-Y plane, one electrode above the ion beam and on electrode below the ion beam. The set of linear shaped compensation electrodes 78" comprises a pair of elongate electrodes having a linear profile in the X-Y plane, one electrode above the ion beam and on electrode below the ion beam. In FIG. 11, for each set of compensation electrodes 78' and 78" only one electrode of the pair is visible as the other electrode of the pair is located directly below the one shown. After N reflections between the two ion mirrors 6, 8 the ions are detected by the detector 74. Advantageously, due to the focusing properties of the drift focusing lens 72, whereby the ion beam width in the drift direction Y is substantially the same (e.g. +/−30%, or +/−20%, or +/−10%) at the detector 74 as at the drift focusing lens 72, all ions are detected after completing exactly the same number N of reflections between the ion mirrors, i.e. there are no detected "overtones". Furthermore, the detection of all ions after completing exactly the same number N of reflections can be achieved with a single focusing lens (converging lens) located early in the reflection system e.g. after the first but before the fourth, third or second reflections, or with a pair of focusing lenses (a diverging lens placed upstream of the converging lens). FIG. 12 shows simulated ion peaks in time (A) and drift space (B) at the detector plane formed by a representative ion packet of m/z=195, for the instrument configuration shown in FIG. 11. It can be seen that as well as maintaining good drift focusing, the build-up of time-of-flight aberrations is limited, giving a resolving power in excess of 100,000. In some embodiments, it may be beneficial to include further lenses along the ion path. The form of multi-reflection ToF spectrometer shown in FIG. 11 has the advantage of good tolerance to mechanical errors in the assembly and alignment of the mirrors, as the resultant broad deflection to the ion trajectory can be easily corrected by adjusting the deflector and/or compensation electrode voltage to compensate.

Figure 13A:
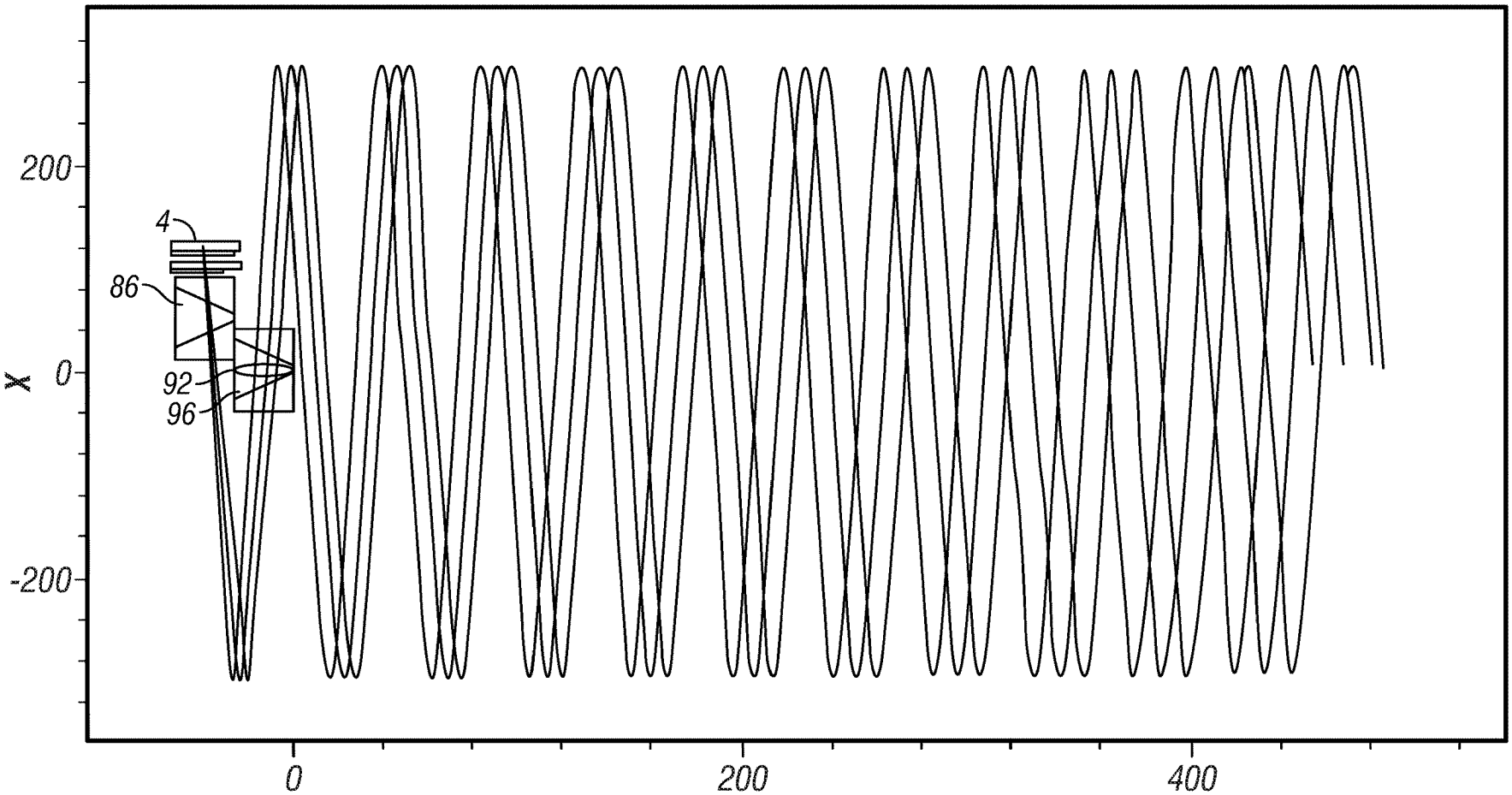
FIG. 13A shows simulated trajectories for a beam of ions with a single focusing lens arrangement.
Figure 13B:
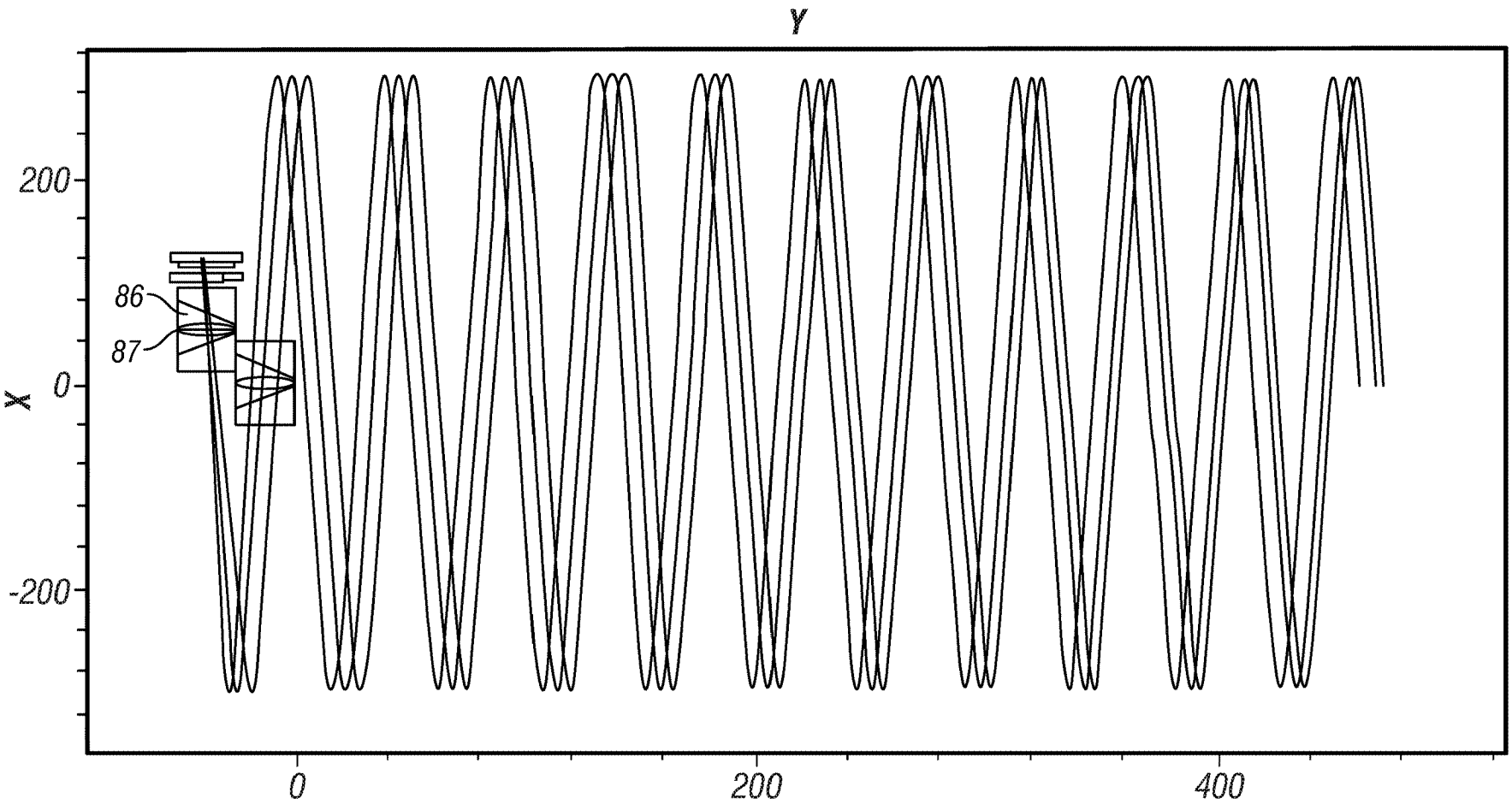
FIG. 13B shows simulated trajectories for a beam of ions with a two lens arrangement.

It has been found that having a diverging lens located shortly after the ion injector (ion trap), preferably between the ion injector and the first reflection, is beneficial to optimise the expansion of the ion beam before it reaches the main drift focusing lens (the converging focusing lens). Thus, a "telescopic" lens system is preferred. The diverging lens preferably has a strong voltage applied to it as the beam is initially very narrow. In the embodiments described above with reference to FIGS. 5, 6 and 11, a voltage of +750V was found to optimise ion beam expansion to the second focusing lens positioned after the first reflection, which had −125V applied. To illustrate this, FIG. 13 shows the expansion of a thermal ion beam that is 2 mm wide in the drift direction Y at the ion injection trap (spatial and thermal divergence plotted) over 22 reflections for single lens (A) and telescopic two-lens (B) configurations. In single lens configuration (A), the converging lens 92 is an elliptical drift focusing lens as described above mounted within a deflector 96 of the above described prism type. There is a first deflector 86 provided before the first reflection to adjust the injection inclination angle but there no diverging lens. In the two lens configuration (B), the system is the same except that a diverging drift focusing lens 87 is provided before the first reflection, wherein lens 87 is an elliptical drift focusing lens mounted within the prism type deflector 86. It can be seen that ion reflections eventually start to overlap along the central axis in the single lens case (A), as the 2 mm initial beam width is too great, but not with the two lens configuration (B). Thus, the two lens configuration enables a greater number of total reflections N to be used. In some embodiments, it may be possible to have both diverging and converging lenses located before the first reflection in the ion mirrors, however such arrangements are much less preferable due to the constraints on the initial beam width and phase volume and the lens voltage that would be required.

Figure 14:
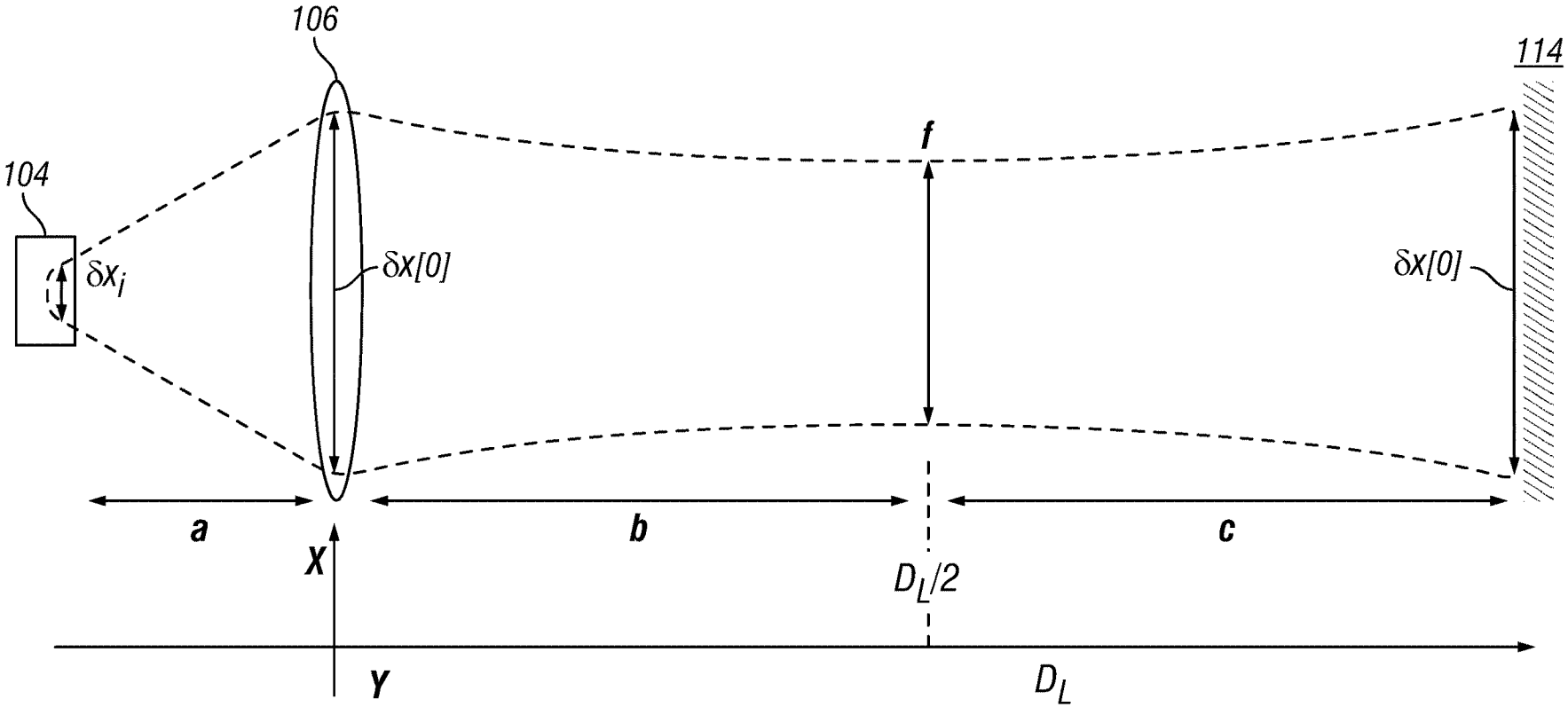
FIG. 14 shows schematically a representation of an ion beam width δx as ions progress along the drift dimension.

The difficulty in collimating an ion beam with lenses comes from ions initially having independent distributions in space and energy. A lens that controls expansion due to the initial ion energy spread will induce convergence from the initial spatial spread. This cannot be eliminated but may be minimised by allowing (or inducing) a large expansion in the beam width. As complete collimation is impossible, it has been found that having a small convergence of the ion beam after the focusing lens is preferable. In order to maximise the ion beam path length, the ion beam spatial spread in the drift direction passes through a single minimum at a mid-way point between the converging drift focusing lens and the detector. After the minimum the ion beam then begins to diverge until the ion beam strikes the detector plane with a similar spatial spread as the beam had at the drift focusing lens. The focusing system is represented schematically in FIG. 14. The ion injector 104, wherein ions have initial spatial spread $dx_i$ in the drift direction, injects ions to the converging drift focusing lens 106 located between the ion mirrors (e.g. between first and second reflections). The ions diverge in the beam expansion region a that is defined between the ion injector 104 and the drift focusing lens 106. The ion beam reaches its maximum spatial spread dx[0] in the drift direction Y at the drift focusing lens 106. Thereafter, the lens 106 focuses the ion beam so that it converges, over converging region b, to its focal minimum (minimum spatial spread) or gorge in the drift direction Y at position f. The focal minimum at position f occurs approximately at a distance halfway between the drift focusing lens 106 and the detector 114. After the focal minimum f, the ion beam again diverges, over diverging region c, until it reaches the detector 114, at which point the ion beam reaches its maximum spatial spread dx[0] in the drift direction Y again.

An optimised analytical solution is now described. The mass resolving power of a ToF mass spectrometer is known to be proportional to the total flight length L. In a multi-reflection ToF mass spectrometer of the type described FIGS. 5, 6, 11 and 13, the total flight length $L=K\times L_0$ where K is the number of oscillations between mirrors and $L_0$ is length of a single oscillation, the latter is approximately double the distance between the mirrors, W. The value K is equal to half the total number of reflections (N), i.e. K=N/2. The drift step per one oscillation is:

$$\Delta_D = W/\sin\theta$$

where θ is the injection angle (the angle of the ion beam to the direction X as it enters the mirrors and thus reflects between the mirrors, around 2 degrees being typical). Accordingly, the number of oscillation on the whole drift length $D_L$ is:

$K=D_L/\Delta_D$

This may be increased by choosing a smaller injection angle that leads to a smaller drift step $\Delta_D$. The drift step has, nevertheless, a low limit $\Delta_{D(min)}$ determined by a minimal separation between neighbouring oscillations.

The phase volume of the ion beam in the direction of drift is denoted as Π. As the phase volume is constant along a trajectory according to the Liouville's theorem, Π is determined by the ion injector and cannot be modified by any collimation optics. Such optics may, however, be used to 'prepare' the ion beam before injection into the analyser by setting the optimal ratio between the spatial and the angular spreads and optimal correlation.

There is a minimum of the ion-beam spatial spread $\delta x_0$ on the oscillation $k_0$. As there are no optical elements for collimating the ion trajectories in the drift direction between the first and the last oscillations, the angular spread $\delta\alpha$ stays constant and the spatial spread on any oscillation k is:

$$\delta x[k]=\sqrt{\delta x_0^2+W^2(k-k_0)^2\delta\alpha^2}$$

The optimization target consists in maximization of the total flight length with respect to $\Delta_D$ and the phase distribution of the ion beam, the optimum being subject to following restrictions:

1) The spatial spread on the first oscillation $\delta x[0]\leq\Delta_D/2$ to prevent overlap between the ion beam after first reflection and the ion source (or collimator)
2) The spatial spread after the last oscillation $\delta x[K]\leq\Delta_D/2$ to prevent overlap between the ion beam on the last but one (K−1) oscillation and the ion detector
3) The phase volume in the direction of drift is $\delta x_0\delta\alpha=\Pi$ is fixed.

It is easy to see that the optimal position of the ion beam's gorge (the minimum spatial spread) $\delta x_0$ is on the middle oscillation $k_0=K/2$, which gives:

$$\delta x[0]^2=\delta x[K]^2=\frac{\Pi^2}{\delta\alpha^2}+W^2\left(\frac{K}{2}\right)^2\delta\alpha^2\leq\frac{\Delta_D^2}{4}=\left(\frac{D_L}{2K}\right)^2$$

In the optimum case, the inequality turns to equality, and the optimal value of the angular spread to maximize the number of oscillations K is given by the equation dK=0

$$\delta\alpha(opt)=\sqrt{\frac{2\Pi}{WK(opt)}},$$

$$K(opt)=\left(\frac{D_L^2}{4\Pi W}\right)^{1/3}$$

As an example, for a 1 mm wide (in Y) ion cloud at the ion injector, with reasonable inter-mirror distance and drift length given by Wand $D_L$:

$$W=1000\text{ mm},$$

$$D_L=500\text{ mm}$$

$$\Pi=1\text{ mm}\times\sqrt{\frac{0.025\text{ eV}}{2\times4000\text{ eV}}}=1\text{ mm}\times1.8\text{ mrad}\cong1.8\times10^{-3}\text{ mm}$$

The value 0.025 eV is the (thermal) energy spread of the ions and 4000 eV is the ion acceleration voltage.

$$K(opt)=\left(\frac{500^2\text{ mm}^2}{4\times1.8\times10^{-3}\text{ mm}\times1000\text{ mm}}\right)^{1/3}\cong32.5$$

$$\delta\alpha(opt)\cong\sqrt{\frac{2\times1.8\times10^{-3}\text{ mm}}{1000\text{ mm}\times32.5}}\cong3.3\times10^{-4}$$

$$\delta x_0=\frac{\Pi}{\delta\alpha(opt)}\cong\frac{1.8\times10^{-3}\text{ mm}}{3.3\times10^{-4}}=5.45\text{ mm}$$

$$\delta x[0]=\delta x[K]=\sqrt{\delta x_0^2+\left(W\frac{K(opt)}{2}\delta\alpha(opt)\right)^2}$$

$$\cong\sqrt{5.45^2\text{ mm}^2+\left(1000\text{ mm}\frac{32.5}{2}3.3\times10^{-4}\right)^2}\cong7.6\text{ mm}$$

$$\Delta_D=\frac{D_L}{2K}=\frac{500\text{ mm}}{32.5}=7.7\text{ mm}$$

The total flight length is thereby given by:

$$L=K(opt)W=32.5\times1000\text{ mm}=32.5\text{ m}$$

It can be seen in the example that the spatial spread on the first oscillation δx[0] and the spatial spread after the last oscillation δx[K] have a value 7.6 mm that is about √2 times the minimum spatial spread in the system $\delta x_0$ 5.45 mm. In general, the converging lens preferably focuses the ions such that the spatial spread of the ion beam in the drift direction Y has a maximum at the drift focusing lens (and preferably the ion detector) that is 1.2-1.6 times, more preferably 1.3-1.5 times, or about √2 times, the minimum spatial spread.

To provide an optimized system it follows that as the ion beam undergoes K oscillations between the ion mirrors from the ion injector to the ion detector, K preferably has a value within a range that is +/−50%, or +/−40%, or +/−30%, or +/−20%, or +/−10% around the above optimum value, $K_{(opt)}$ given by:

$$K(opt)=\left(\frac{D_L^2}{4\Pi W}\right)^{1/3}$$

Similarly, the angular spread of the ion beam, δα, after focusing by the drift focusing arrangement is preferably within a range that is +/−50%, or +/−40%, or +/−30%, or +/−20%, or +/−10% around the above optimum value, $\delta\alpha_{(opt)}$ given by:

$$\delta\alpha(opt)=\sqrt{\frac{2\Pi}{WK(opt)}}$$

Figure 15:
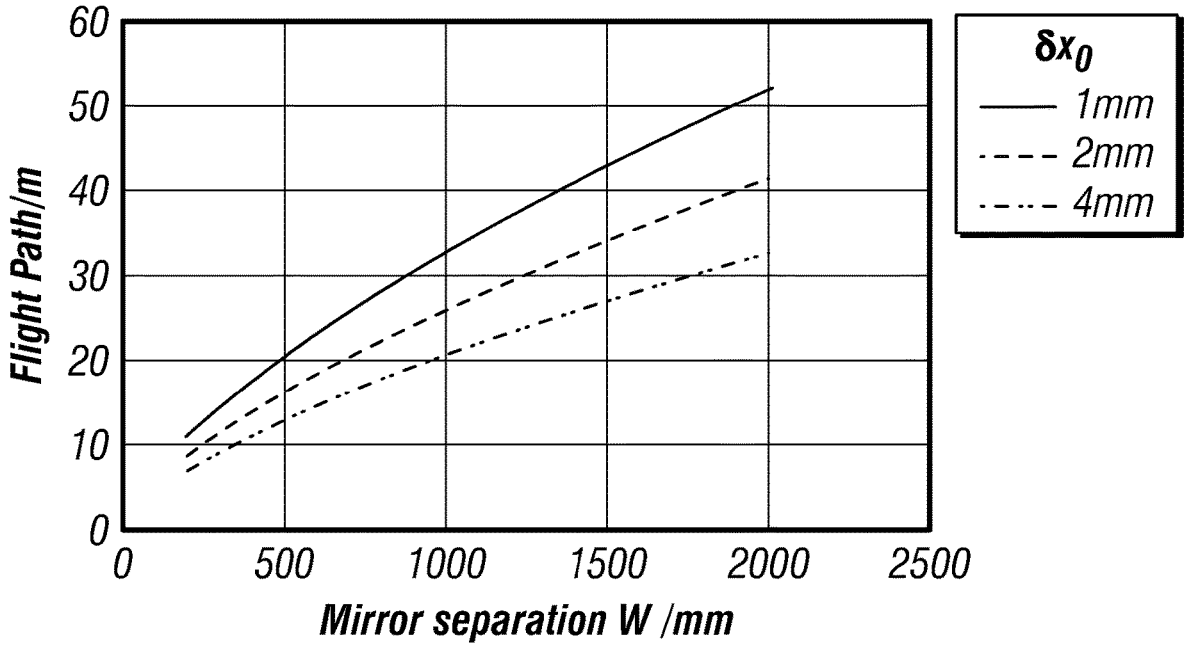
FIG. 15 shows graphs illustrating the effects of varying the initial ion beam width $\delta x_0$, drift length ($D_L$) and mirror separation (W) on the achievable ion flight path length.
Figure 15:
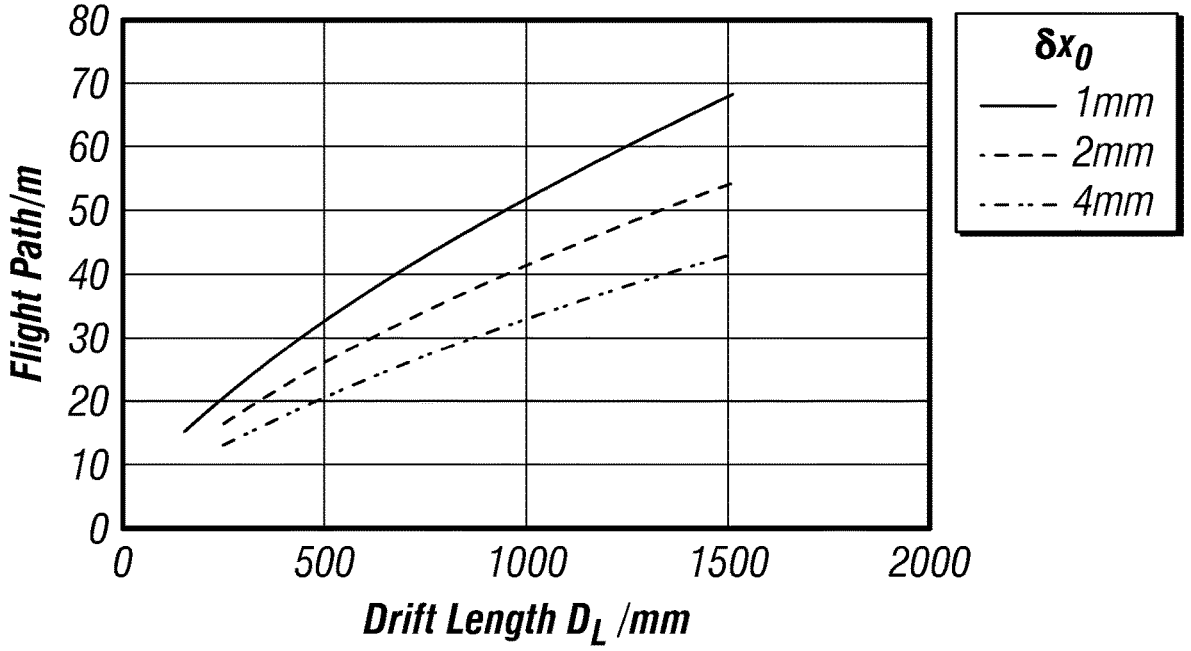

FIG. 15 shows graphs illustrating the effects of varying the initial ion beam width $\delta x_0$, (mirror) drift length ($D_L$) and mirror separation (W) on the achievable flight path length based on this analytical approach. It is clear that very long flight paths are achievable with reasonably practical mirror arrangements (for example, 1.5 m long and 2 m wide may give a 60 m flight path). The graphs show (A) variation of flight path length with mirror separation W (base 1000 mm) and (B) variation of flight path length with drift length $D_L$ (base 500 mm), each for different initial ion population widths $\delta x_0$ (1 mm, 2 mm and 4 mm).

In a further embodiment, as long as the ion beam remains reasonably well focused, it is possible to place a deflector or a deflector/drift focusing lens combo (such as described above), or some other beam direction control means at the distal (far) end of the mirrors from the end at which the ion injector is location, in order to reverse the ion beam's drift velocity. Herein such deflectors are referred to as end or reversing deflectors. This results in reflection of the ions back to the starting end of the mirrors, where a detector can be placed. This enables multiplication (e.g. doubling) of the ions' time-of-flight. It can also be possible in some embodiments to have a deflector in the mirrors at one side to reverse the beam again for multiplication of the ions' time-of-flight. Such end or reversing deflectors, preferably have a wide spatial acceptance and operate in an isochronous manner. Another consideration is that positioning the detector proximate to the ion injector introduces space restrictions. One workaround disclosed in U.S. Pat. No. 9,136,101 is to inject ions with a high injection angle to improve the clearance and then use a deflector located after the first reflection to reduce this injection angle. Another possible solution to the problem of space and injection angle is disclosed in U.S. Pat. No. 7,326,925 which uses sectors to carry out ion injection at a small angle and optionally extraction to a detector. Increasing the ion mirror spacing is another possible solution.

Figure 16:
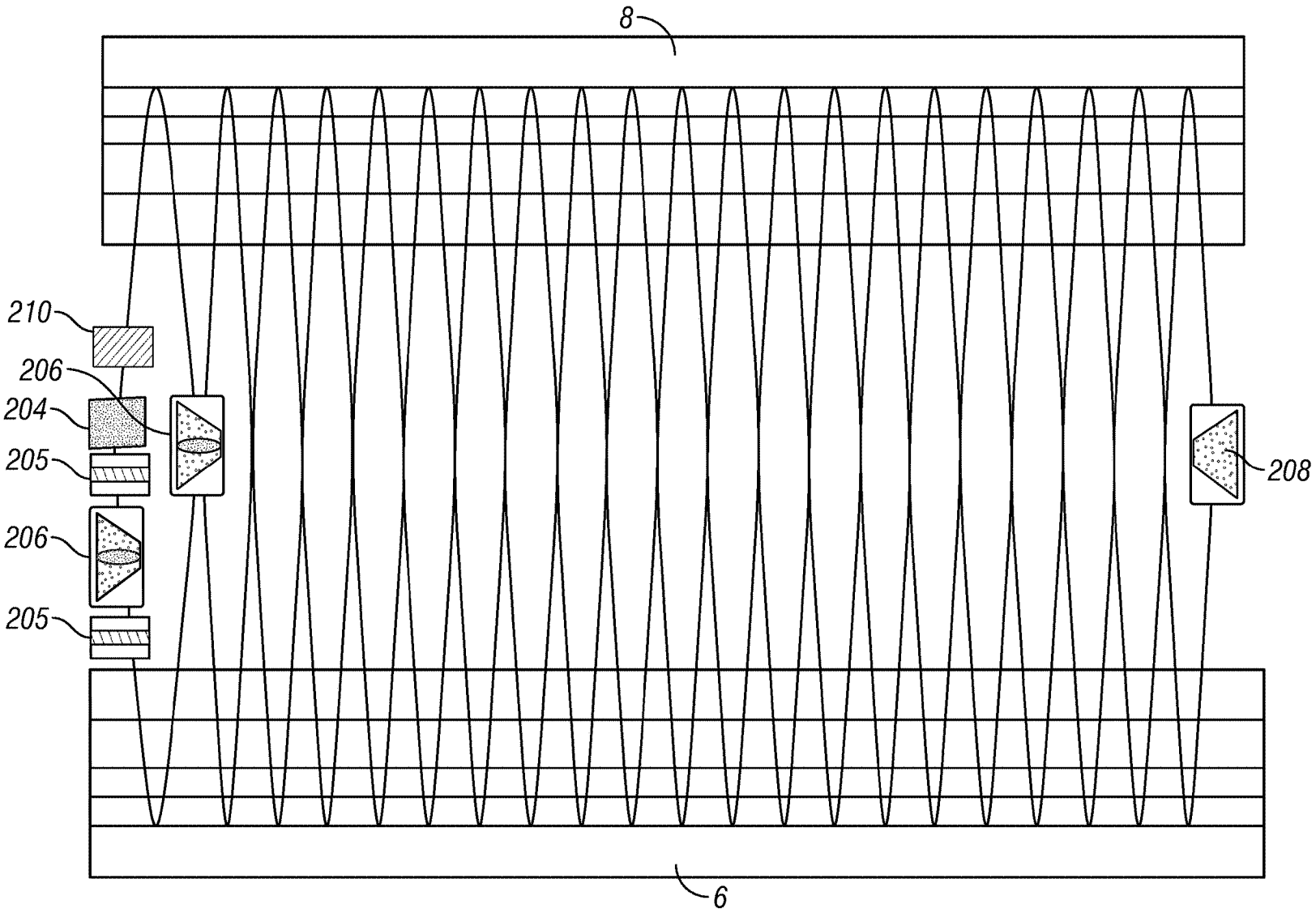
FIG. 16 shows schematically an embodiment of a multi-reflection ToF configuration incorporating a reversing deflector to return the ion beam back to a drift zero position.

An embodiment of a system employing a reversing deflector at the distal end is shown in FIG. 16. However, this embodiment is less preferred as the time aberrations from both of these deflectors become damaging to resolving power. Ion injector 204, located at Y=0, injects ions and first and second deflectors 206, each with integrated drift focusing lenses, adjust the injection angle. Out of plane lenses 205 are also used in the injection optics. The second drift focusing lens focuses the ions as described above with a focal minimum halfway along the ion path. After N/2 reflections along a zigzag flight path, where N is the total number of reflections that ions undergo in the system, the ion beam's drift velocity is reversed along Y by a reversing deflector 208 located at the distal end of the mirrors 6, 8 from the ion injector 204. The deflector 208 is a trapezoid shaped, prism type as described above. This results in reflection of the ions back to towards the starting end of the mirrors, the ions undergoing a further N/2 reflections along the zigzag flight path until they reach an ion detector 210 placed proximate to the ion injector 204 at Y=0. Convergence of the ion mirrors at an entrance portion of their length could be used instead of a deflector to reduce the initial injection angle (e.g. a decelerating stage such as described in US 2018/0138026 A1), which in combination with a compensation electrode would eliminate the timing error from this first deflector completely. It is also possible to correct part of the aberration from the deflector which sets the injection angle with a dipole field placed immediately in front of the detector as in US 2017/0098533.

The beam reversing deflector should preferably incorporate a mechanism to minimise time-of-flight aberration incurred across the width of the ion beam. Two methods to reduce this effect are now described.

Figure 17:
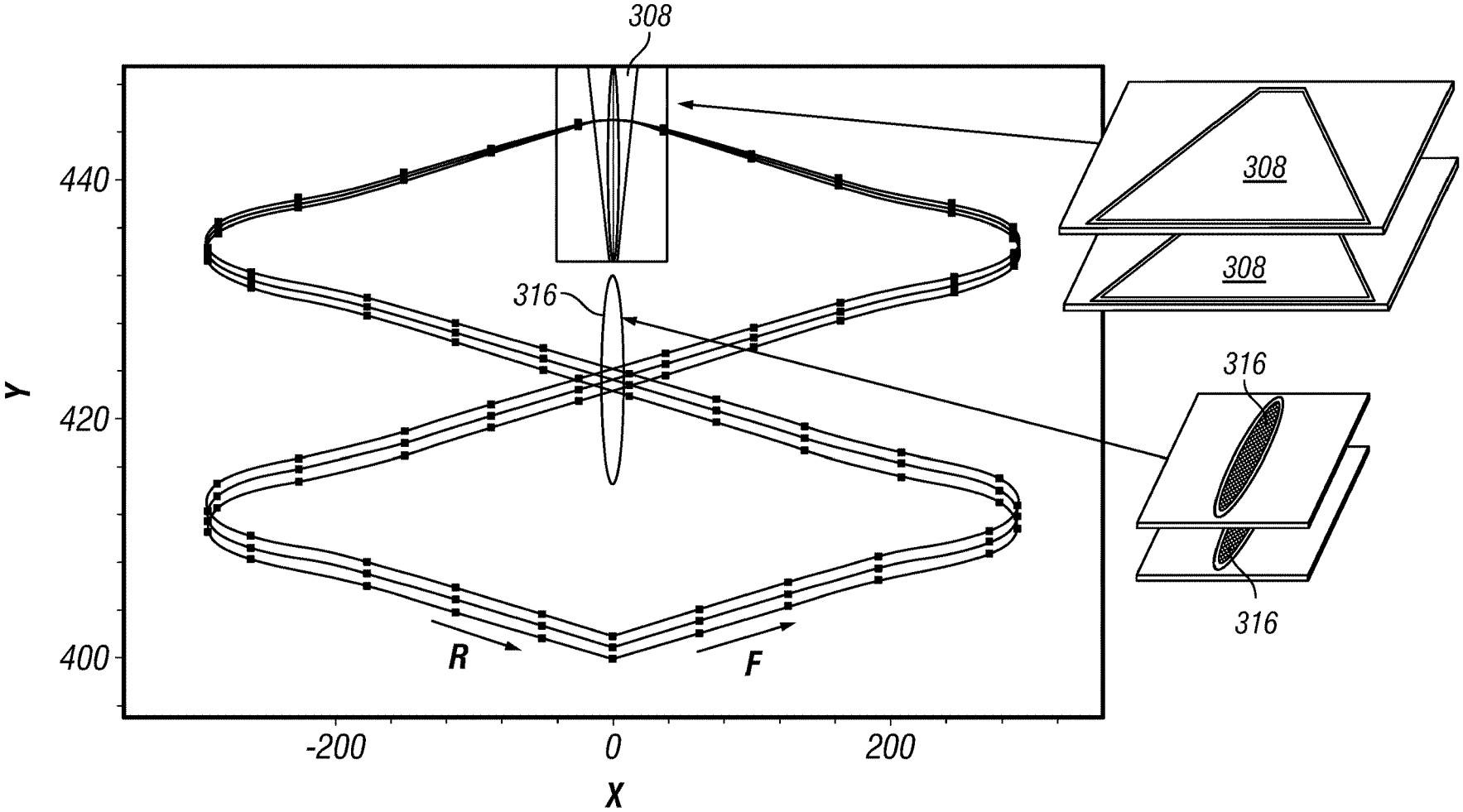
FIG. 17 shows ion trajectories near the end of a mass analyser incorporating a drift reversing deflector and a focusing lens positioned one reflection before the reversing deflector.
Figure 18:
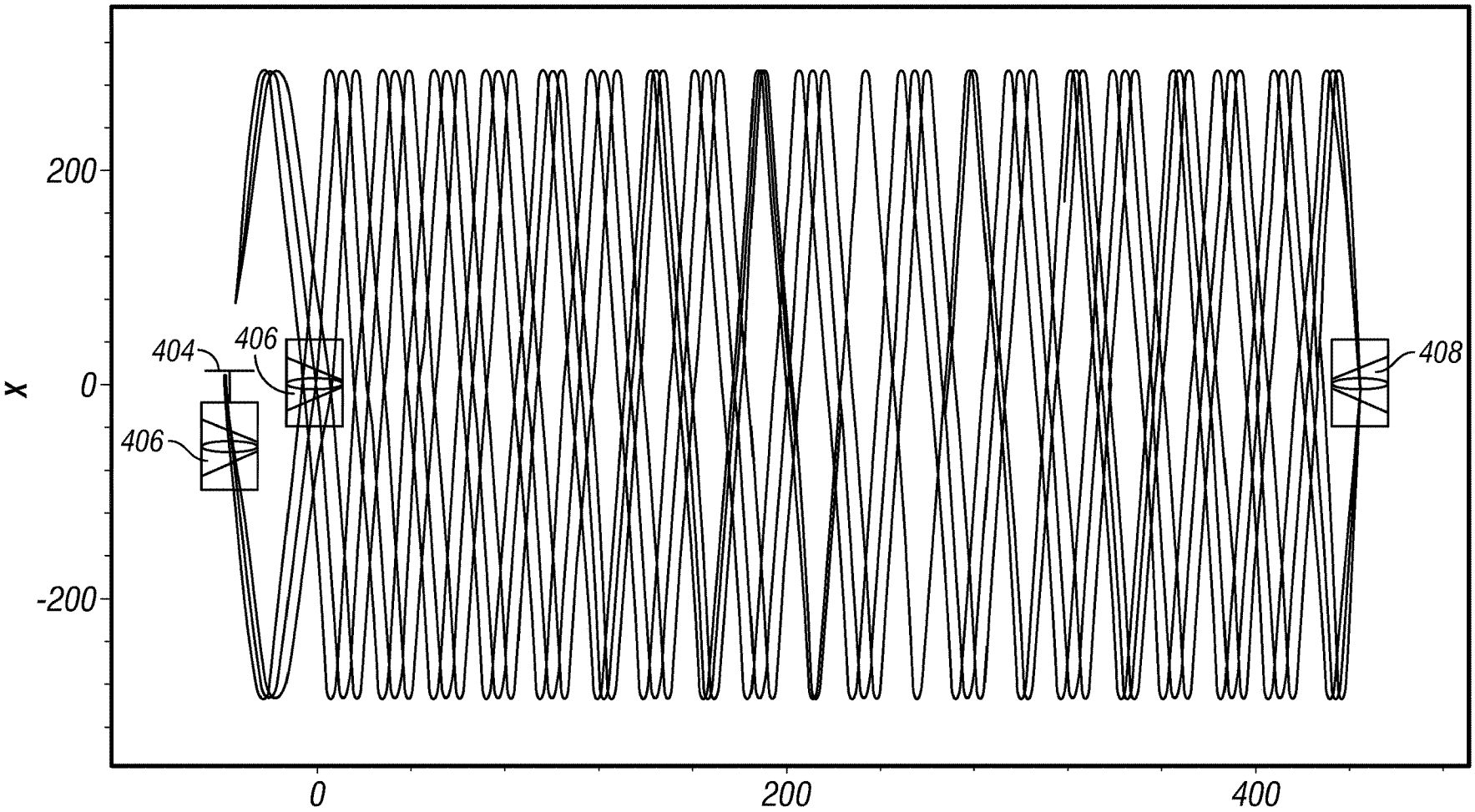
FIG. 18 shows simulated ion trajectories with thermal drift divergence through a complete analyser incorporating first and second deflectors to reduce initial drift energy and a third deflector to reverse the ion drift back to a detector with minimised time aberration.

The first method is the minimisation of the ion beam width via a focusing lens the turn before beam drift-reversal. A lens can be positioned so that ions pass through it prior to reaching the reversing deflector, preferably one reflection prior to reaching the reversing deflector. The voltage of the lens can be set so that the (relatively wide) ion beam is focused almost to a point within the reversing deflector, thereby minimising ToF aberrations. Thus, the lens preferably has a point focus within the reversing deflector. The ion beam can then diverge to its original width on the return path along the drift direction Y as it passes through such lens a second time, as shown in FIG. 17. The beam can thereby be collimated for the return path by passing through the lens. FIG. 17 shows schematically the beam reflections near to the distal end of the mirrors. The forward direction of the ion beam is shown by arrow F and the reverse direction by arrow R. The reversing deflector 308 is shown positioned at the distal end of the ion mirrors. The trapezoid or prism-type structure of the electrodes of the reversing deflector 308 are shown positioned above and below the ion beam. An ion drift focusing lens 316, which in the shown embodiment is an elliptical shaped, trans-axial lens, is positioned one reflection prior to the reversing deflector 308, and acts to focus the ion beam almost to a point within the reversing deflector. The ion beam then diverges to its original width on the return path R and is collimated by passing through the lens 316 a second time. As an example, in keeping with the above embodiments, a voltage of +300 V can be applied to the reversing deflector 308 and a voltage of −160 V applied to the elliptical lens 316. FIG. 18 shows simulated ions trajectories of ions with a ±3a thermal divergence travelling through a mass analyser according to the present invention that incorporates a reversing deflector. Greater than 200,000 resolution can be achieved with proper alignment of ion injector, detector and deflector voltages. First and second deflectors (prism deflectors) 406 reduce the initial drift energy of the ions from the injector 404 and third deflector 408 (reversing prism deflector) reverses the ion drift back to a detector with minimum time aberration. A preferred system using these components to achieve high resolution comprises to inject the ions into the analyser so that they exit the second deflector (i.e. after the first reflection) with a focal plane that is parallel to the drift direction Y, which minimises any focal plane tilt that might be imperfectly corrected on the ions' return journey back through the second deflector (prism). This can be achieved by suitably arranging the ion source, for example by turning the ion source back compared to the previous described embodiments, so as to eject ions from the source at a slightly negative drift (e.g. −1.5 degrees), then change the drift to positive by applying a large voltage on the first prism deflector (e.g. +375V). Ions then reach the second prism deflector (e.g. voltage −120V), which sets the injection angle and also aligns the focal plane to the drift axis Y. The downside of this approach is that ions may reach the detector with a linear focal plane tilt induced by the return journey through the second prism deflector, although that can be compensated either by correctly aligning the detector (with the focal plane tilt) or by providing a focal plane tilt correcting device. Thus, in some embodiments, the ion source may be arranged to eject ions in a negative drift direction (away from the mirrors) and a first ion deflector (generally before the first reflection) reverts the ions to a positive drift direction. A second ion deflector (generally after the first reflection) may adjust the inclination angle of the ion beam and/or align the focal plane of the ion beam to the drift direction Y.

Figure 19:
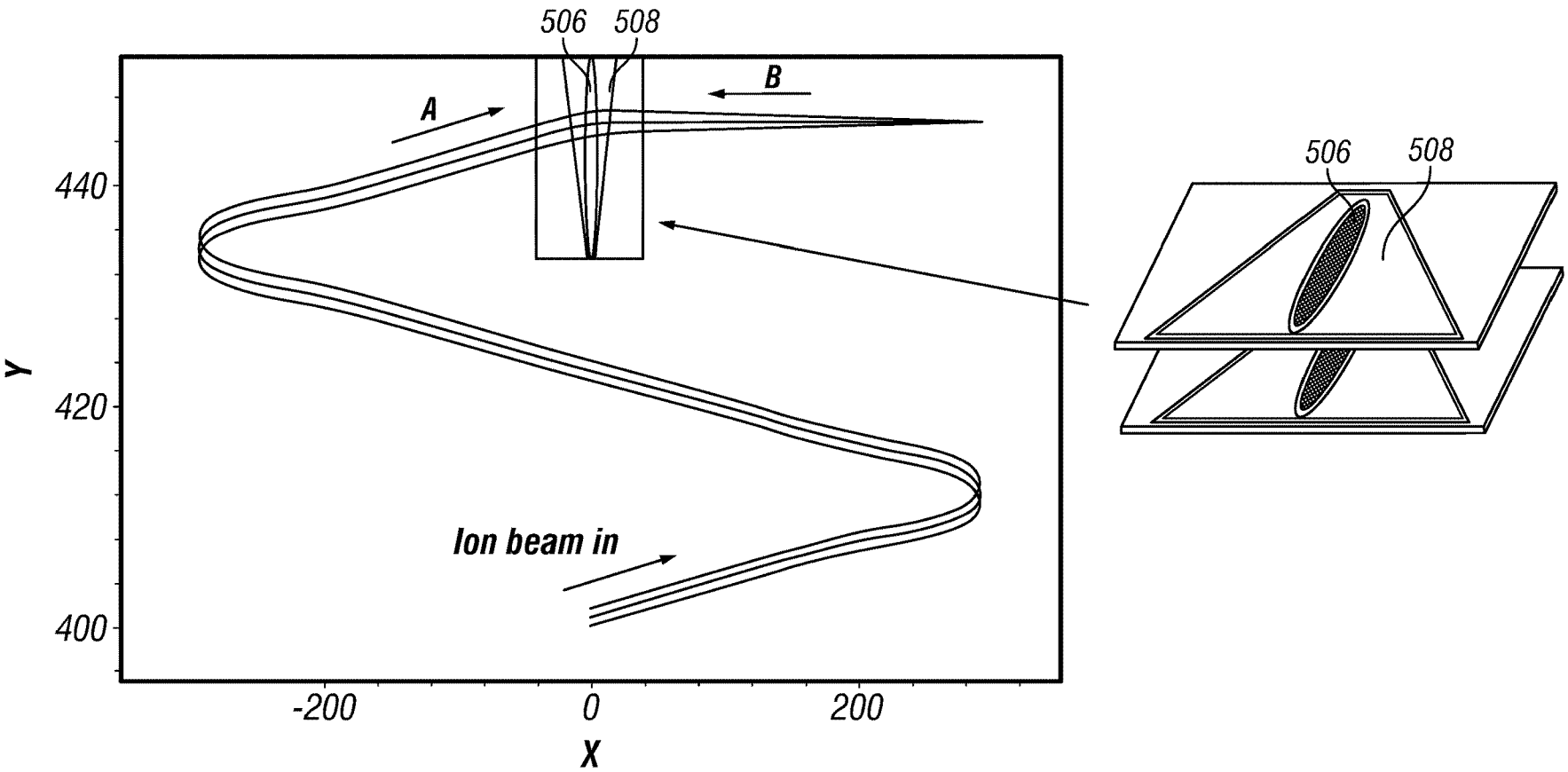
FIG. 19 shows ion trajectories near the end of a mass analyser incorporating a drift reversing deflector for reversal of ion trajectories by two passes through the deflector, in which the deflector incorporates a converging lens for minimisation of time-of-flight aberrations.

The second method for minimising time-of-flight aberration associated with use of a reversing deflector comprises self-correction of the time-of-flight aberration via two passes through the reversing deflector, which has a focusing lens integrated or in close proximity (e.g. not separated from the deflector by a reflection). For example, a deflector, such as a prism deflector for example, operated at half the voltage required to completely reverse the ions in the drift direction Y (impart opposite drift direction velocity), will instead reduce the ions' drift velocity to zero. Thus, when the ions exit the deflector and reach the ion mirror for the next reflection they will be reflected back into the deflector whereupon the deflection acts to change the ions' drift velocity from zero to the reverse drift velocity and the reversal of the ion trajectory is thereby completed. If a focusing lens is incorporated into the deflector, such as a prism type deflector, for example as described earlier and shown in FIG. 7C, or is just placed in proximity to the deflector, focusing can be applied such that when the ions return to the deflector on the opposite side of the deflector from which they enter, the time-of-flight aberration of the deflector for ions going through the deflector one way and the other cancel out. The deflector/lens assembly is thus self-correcting. However, the return angle should be designed to be slightly offset from the injection angle, so that the beam for example reaches a detector instead of simply returning to the ion injector. For example, a slightly lower voltage could be applied on the reversing deflector (so as to provide slightly less than 100% reflection, e.g. 95% instead of 100% reflection). An example of such a system is shown schematically in FIG. 19. Ions travelling in the drift direction from the ion injector first enter the reversing deflector 508 from the left side as shown by the arrow A. The deflector 508 is of the trapezoid, prism type as shown in the expanded drawing. The voltage applied (+150 V) to the deflector is half that applied to effect the full reversal of the drift velocity as shown in FIGS. 17 and 18. This reduces the ions' drift velocity substantially to zero and the ions enter the mirror (not shown) for the next reflection with zero drift velocity. The deflector has an integrated drift focusing lens 506 (e.g. elliptical shape). At the same time as the ions have their drift velocity reduced to zero by the deflector, they are focused to a focal point in the mirror (preferably at their turning point in the mirror). The lens 506 in this embodiment has a voltage −300 V applied to it. After reflection the ions begin to diverge and re-enter the deflector for a second time, this time from the opposite of the deflector as shown by the direction of arrow B. The deflection is thereby applied again, this time having the effect of completing the reversal of the ions' drift velocity. The lens 506 at the same time acts to collimate the ion beam for the return path.

The use of reversing deflectors to reverse the ion beam and double the flight path is known in prior art but these tend to harm resolution. The more isochronous deflection methods presented here are useful to limit the time-of-flight aberrations and preserve resolution. Both are relatively simple constructions. This problem is addressed in the prior art either by having the aberration cancelled out with mirror inclination working in combination with a deflector (U.S. Pat. No. 9,136,101), which is mechanically demanding), or by having the ion beam always compressed with periodic lenses so the aberration on deflection is small (GB2403063) but this suffers from relatively poor space charge performance.

Figure 1:
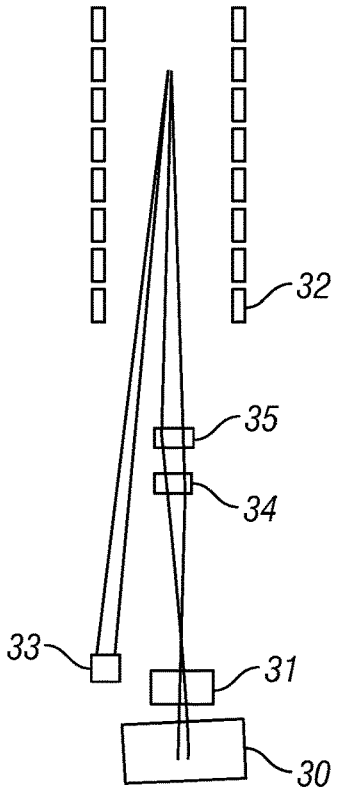
FIG. 1 (PRIOR ART)
FIG. 1 shows schematically an embodiment according to the prior art.
Figure 2:
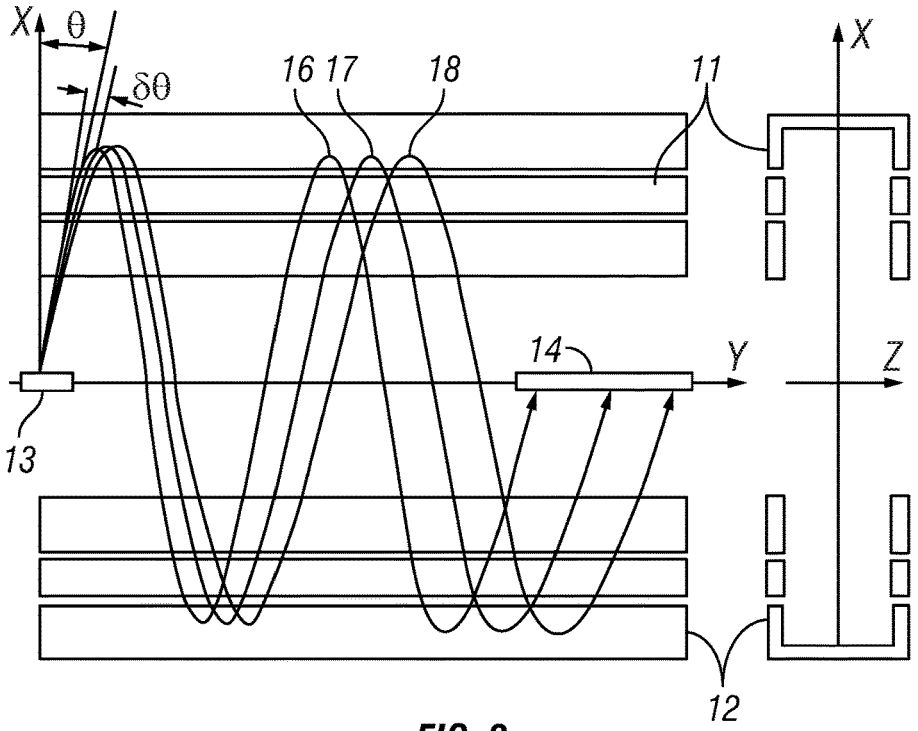
FIG. 2 (PRIOR ART)
FIG. 2 shows schematically another embodiment according to the prior art.
Figure 3:
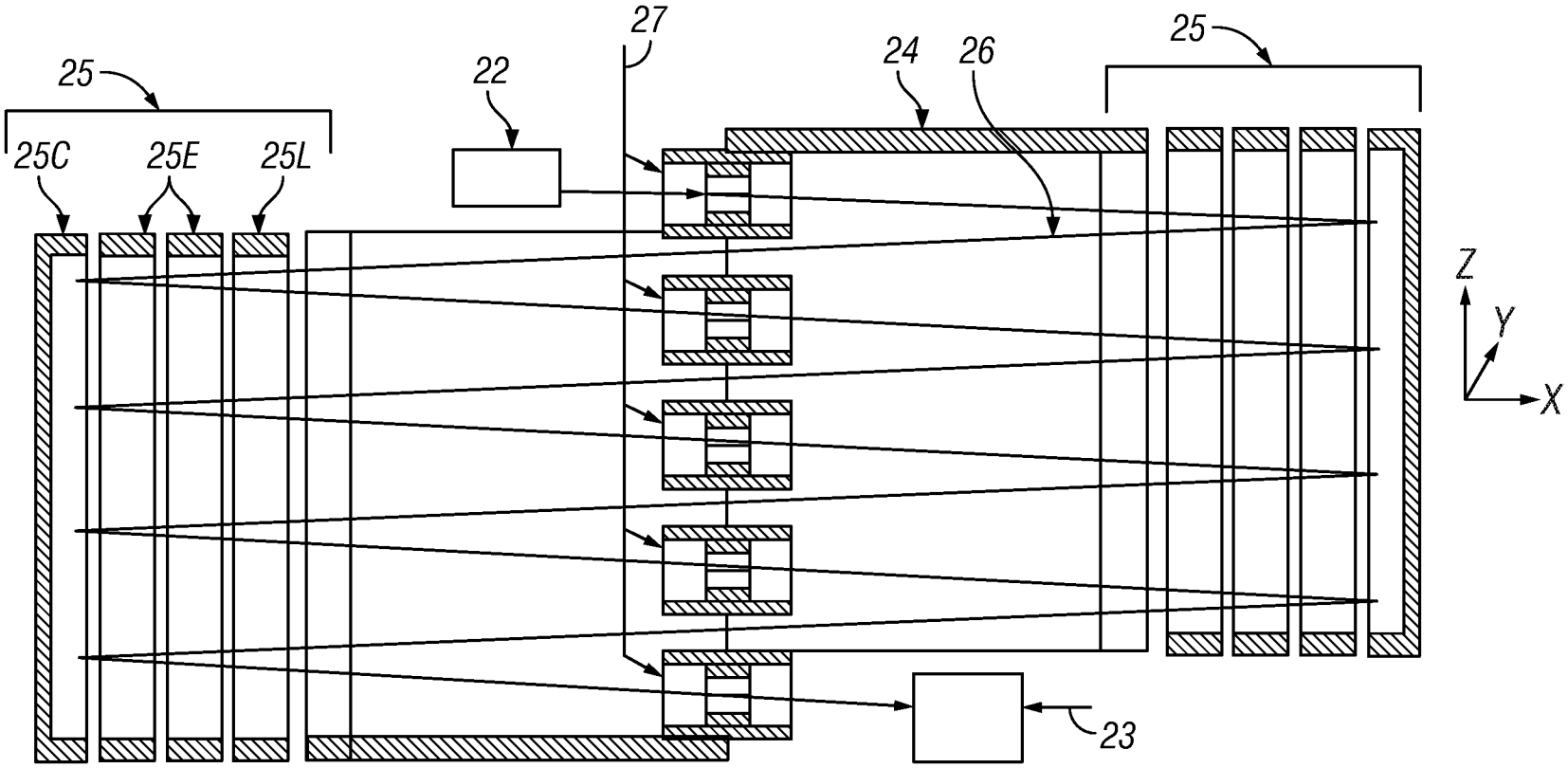
FIG. 3 (PRIOR ART)
FIG. 3 shows schematically a further embodiment according to the prior art.
Figure 4A:
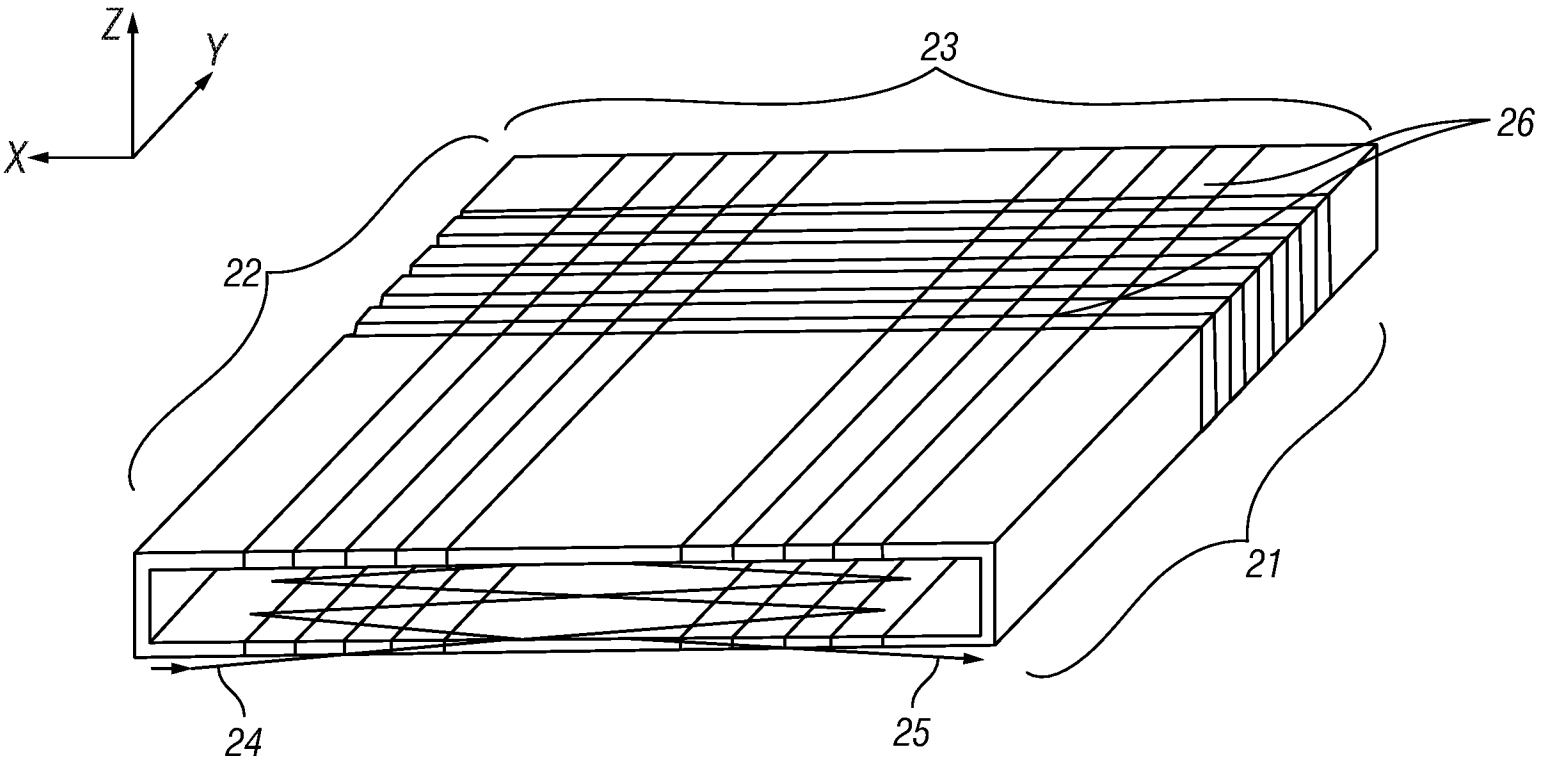
FIG. 4A (PRIOR ART)
FIGS. 4A and 4B show schematically still further embodiments according to the prior art.
Figure 4B:
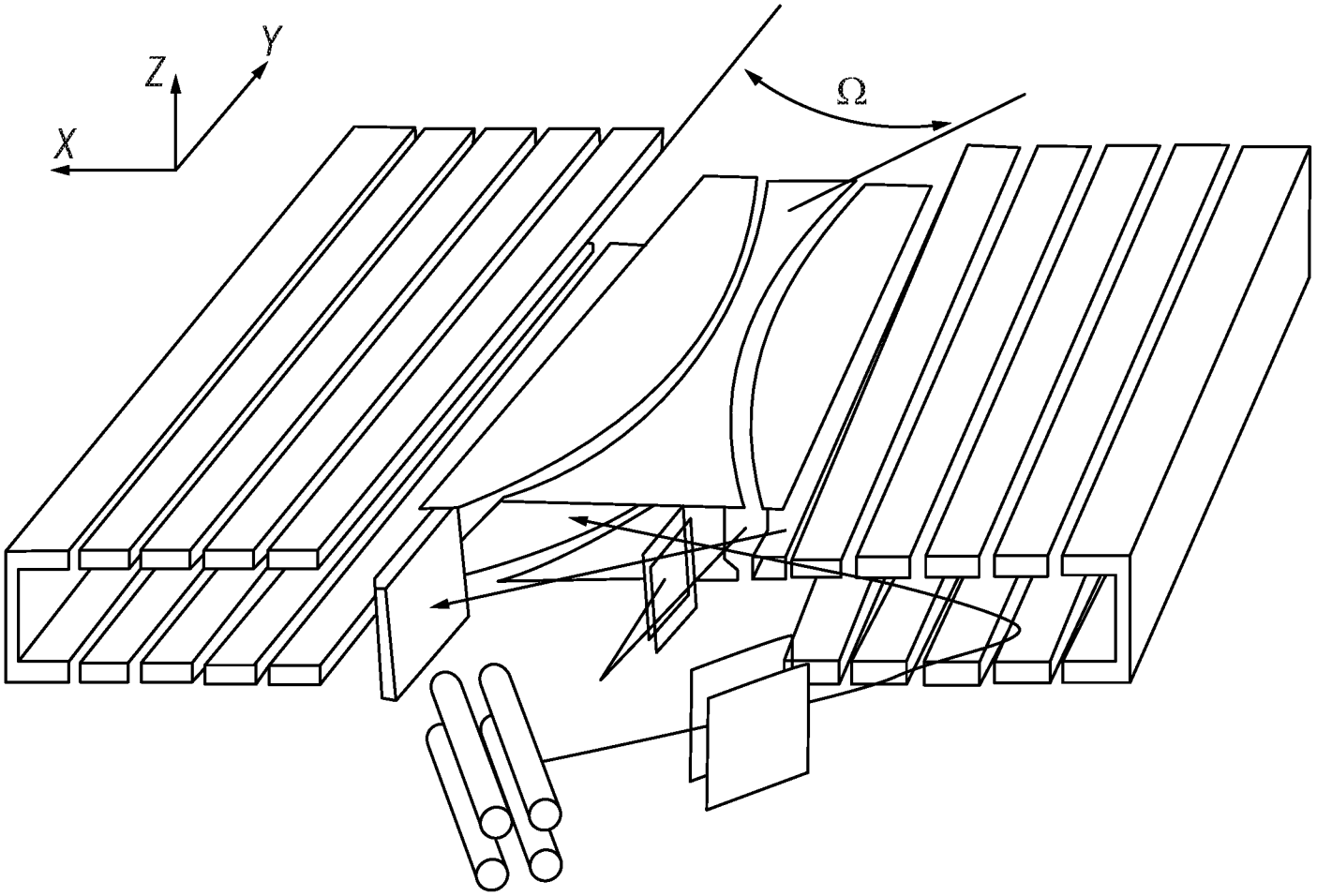
FIG. 4B (PRIOR ART)
Figure 20:
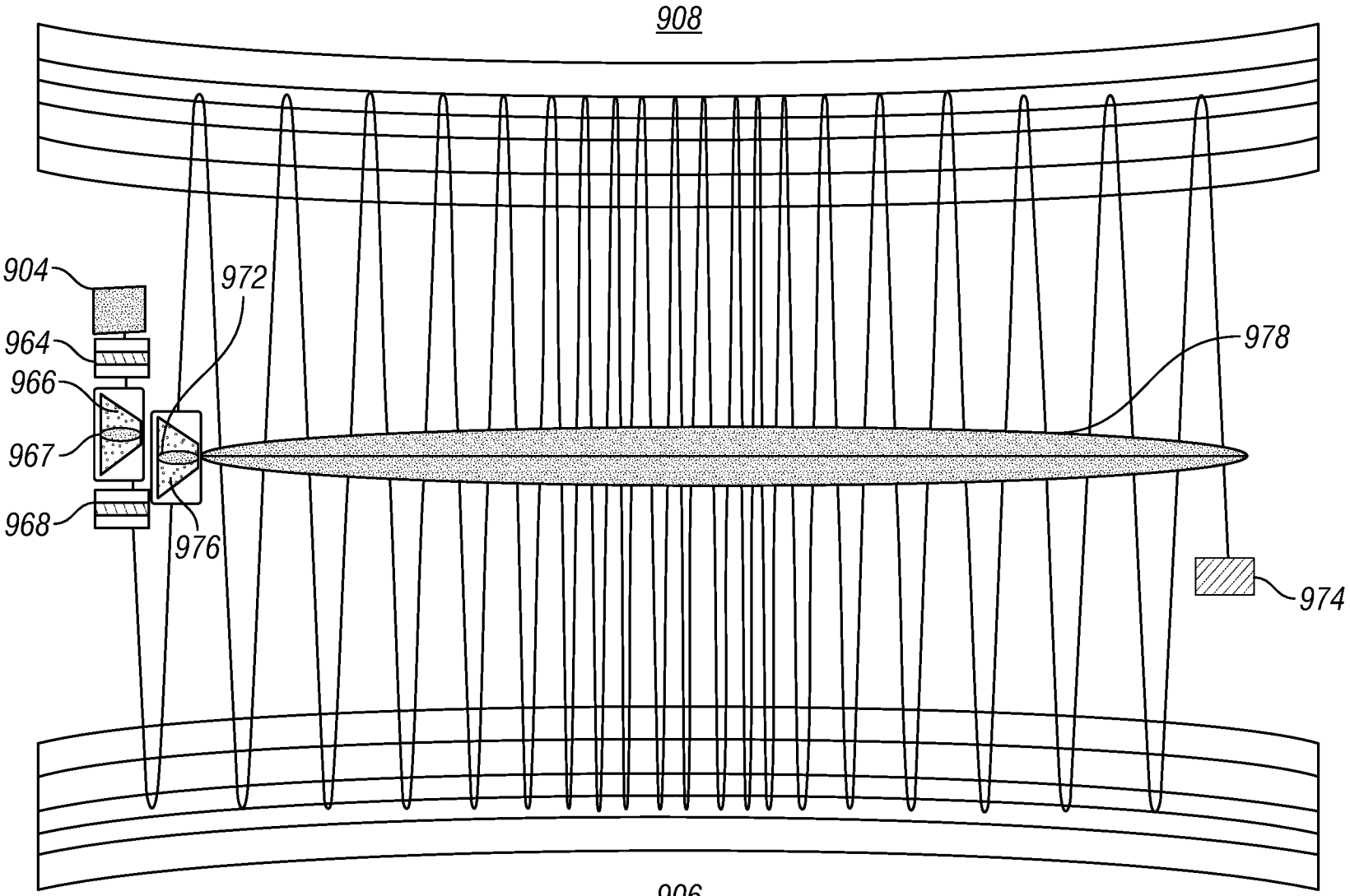
FIG. 20 shows schematically an embodiment having mirror convergence and divergence to maximise the number of oscillations within the mirror space and beam divergence at the detector.

In patent application US 2018-0138026 A1 is described the use of curvature of the mirror electrodes along at least a portion of the drift length of the analyser as a means of controlling the drift velocity and thus maximising the number of reflections within the limited space of the analyser. FIG. 20 shows the apparatus of FIG. 11 modified to incorporate this concept. The ion injection system and ion focusing arrangement is the same as described in FIG. 11 (i.e. comprising ion injector 904, injection optics comprising out of plane lens 964, deflector 966 with integrated drift focusing lens 967, second out of plane lens 968 and deflector 976 with integrated drift focusing lens 972. Mirrors 906, 908 first converge along a first portion of their length in the drift direction Y to reduce ion drift velocity, for example as described in US 2018-0138026 A1, the contents of which is hereby incorporated by reference in its entirety. The first portion of their length is adjacent to the ion injector. The mirrors preferably first converge following a curved function to reduce drift velocity, although, the convergence could be linear for example. Thereafter, the ion mirrors run parallel (or close to parallel) to maximise the number of reflections and then diverge to separate the different reflections and maximise space for the detector 974. The mirrors preferably diverge following a curved function, although, the divergence could be linear for example. The convergence and divergence need not match (be symmetrical), and the central region may even be completely flat (parallel). A set of elongated time of flight compensation electrodes 978 (one above and one below the ion beam) with a shape matching the mirror curvature (or its inverse) is preferably positioned centrally between the ion mirrors to correct the time-of-flight aberrations of the mirror curvature. For a 2 degree injection angle of 4 kV ions, mirror convergence (difference between the furthest mirror separation and the shortest separation) should be <600 μm to prevent drift reflection of some ions. The more strongly converging and diverging regions preferably incorporate multiple reflections to prevent ion scattering (deflection remains adiabatic). As described in US 2018-0138026 A1, reduction of ion drift velocity by mirror convergence may be achieved with flat angled mirror surfaces instead of smoothly curving mirrors. The use of mirror convergence/divergence to maximise the number of turns within the mirror is obviously advantageous, however comes at the cost of defocusing the ion beam in the drift dimension. Modest reductions in drift velocity (~25%) were seen to be feasible in simulation before drift focusing became untenable, even with higher order gaussian functions. A converging mirror method is disclosed in U.S. Pat. No. 9,136,101 but it requires reversal of the ions and involves locating the detector and the ion source in the same space between the mirrors, which is not necessary in the embodiments described here. Another method to achieve similar results to applying convergence/divergence of the distance between the mirrors in the drift direction Y would be to reduce/increase the height of the electrodes' apertures (the height of the mirror apertures in the Z direction) towards/away from the centre of the ion mirrors in the drift direction Y. A third way would be to perturb the mirror field by applying a perturbation potential via additional electrodes within the mirrors, for example one or more additional electrodes between the electrodes of the mirrors, such as those described in WO 2019/030472 A1, so as to increase the potential (for positive ions) towards the Y centre (towards the centre of the ion mirrors in the drift direction Y or mid-point of the ion beam path) and decrease it towards the drift termini (towards the ends of the ion mirrors or the beginning and end of the ion beam path). For negative ions, the direction of such a potential would be reversed. As an example, additional wedge shaped electrodes located between the ion mirror electrodes could be used to provide the perturbation potential (such as shown in FIG. 3 of WO 2019/030472 A1). The extent of the wedge shape of the electrode changes along the drift direction Y and therefore so does its perturbation potential. Alternatively, straight (non-wedged) additional electrodes could be used that provide a perturbation potential that varies along the drift direction Y. A similar form of correction or compensation electrode, not disclosed in prior art, would be an electrode extending along the back of a mirror or each mirror, for example a wedge shaped electrode that increases in height (and thus voltage perturbation of the reflecting part of the ion mirrors) along the drift direction Y. Such electrodes have a disproportionate effect on time-of-flight compared to drift, so may be best paired with a function-matching stripe shaped compensation electrode between the mirrors to balance the two properties. However, such electrodes are not generally preferred as the field penetrates through the back of the mirror in an exponential manner, leading to disproportionate effects on ions with high energy and consequent loss of energy acceptance by the mirror.

Figure 21:
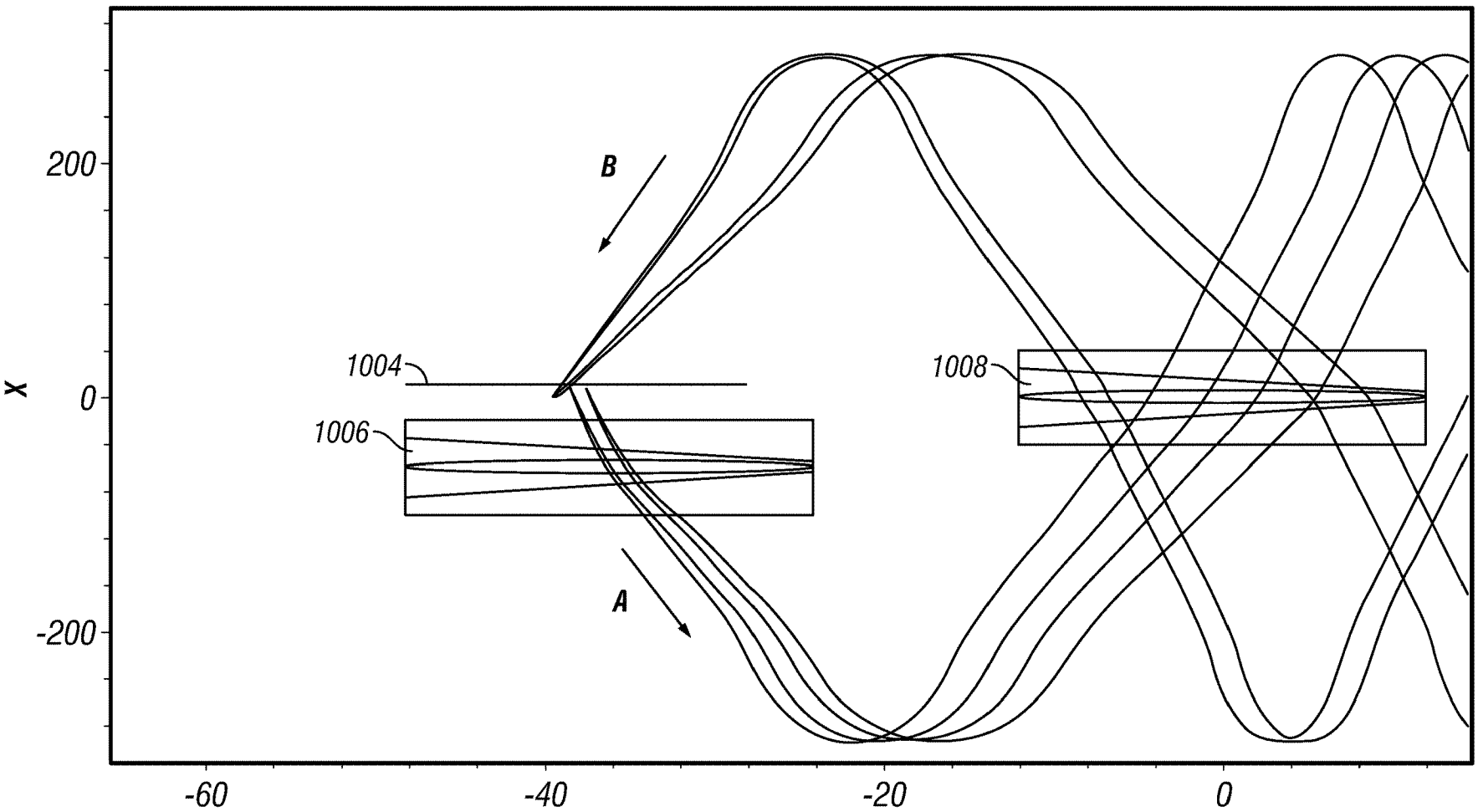
FIG. 21 shows simulated ion trajectories with differing source position and energy, showing that the return position is correlated to the start position.

Multi-reflection mass spectrometers of the present invention may be combined with a point ion source such as laser ablation, MALDI etc for imaging applications, where each mass spectrum corresponds to a source point and images are built up over many points and corresponding mass spectra. Thus, in some embodiments, ions may be produced from a plurality of spatially separate points on a sample in an ion source in sequence and from each point a mass spectrum recorded in order to image the sample. Referring to the system shown in FIG. 16, incorporating the deflector of FIG. 17, one of its properties is that the ion position at the end of the system is strongly related to the ion position in the ion source. This shows that a multi-reflection ToF analyser with a long range focal lens and reversing deflector may be suitable for "stigmatic imaging" with an imaging detector (e.g. a 2D detector array or pixel detector), where the ion distribution within an area along the source surface may be imaged with a single extraction of ions. Simulated trajectories of ions with variation in initial spatial and energy components are shown returning to a detection plane with an energy focus in FIG. 21. The focal point is tuneable with respect to energy. Ions leave the source plane 1004 from a point and pass through the ion focusing arrangement comprising first deflector/lens arrangement 1006 and second deflector/lens arrangement 1008 of the configuration shown in FIGS. 11 and 16. The ions' initial direction is shown by arrow A and the return ion beam after being reversed in the drift direction Y by a reversing deflector (not shown) is shown by arrow B. The ions return to the source plane at a corresponding point, where a detector (not shown) may be located in proximity.

The embodiments presented above could be also implemented not only as ultra-high resolution ToF instruments but also as low-cost mid-performance analysers. For example, if the ion energy and thus the voltages applied do not exceed a few kilovolts, the entire assembly of mirrors and/or compensation electrodes could be implemented as a pair of printed-circuit boards (PCBs) arranged with their printed surfaces parallel to and facing each other, preferably flat and made of FR4 glass-filled epoxy or ceramics, spaced apart by metal spacers and aligned by dowels. PCBs may be glued or otherwise affixed to more resilient material (metal, glass, ceramics, polymer), thus making the system more rigid. Preferably, electrodes on each PCB may be defined by laser-cut grooves that provide sufficient isolation against breakdown, whilst at the same time not significantly exposing the dielectric inside. Electrical connections may be implemented via the rear surface which does not face the ion beam and may also integrate resistive voltage dividers or entire power supplies.

For practical implementations the elongation of the mirrors in the drift direction Y should not be too long in order to reduce the complexity and cost of the design. Preferably means are provided for compensating the fringing fields, for example using end electrodes (preferably located at the distance of at least 2-3 times the height of mirror in Z-direction from the closest ion trajectory) or end-PCBs which mimic the potential distribution of infinitely elongated mirrors. In the former case, electrodes could use the same voltages as the mirror electrodes and might be implemented as flat plates of appropriate shape and attached to the mirror electrodes.

The spectrometer according to the invention in some embodiments may be used as a high resolution mass selection device to select precursor ions of particular mass-to-charge ratio for fragmentation and MS2 analysis in a second mass spectrometer. For example, in the manner shown in FIG. 15 of U.S. Pat. No. 9,136,101.

As used herein, including in the claims, unless the context indicates otherwise, singular forms of the terms herein are to be construed as including the plural form and vice versa. For instance, unless the context indicates otherwise, a singular reference herein including in the claims, such as "a" or "an" means "one or more".

Throughout the description and claims of this specification, the words "comprise", "including", "having" and "contain" and variations of the words, for example "comprising" and "comprises" etc, mean "including but not limited to" and are not intended to (and do not) exclude other components.

It will be appreciated that variations to the foregoing embodiments of the invention can be made while still falling within the scope of the invention as defined by the claims. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The use of any and all examples, or exemplary language ("for instance", "such as", "for example" and like language) provided herein, is intended merely to better illustrate the invention and does not indicate a limitation on the scope of the invention unless otherwise claimed. No language in the specification should be construed as indicating any non-claimed element as essential to the practice of the invention.

The invention claimed is:

1. A multi-reflection mass spectrometer comprising:

two ion mirrors spaced apart and opposing each other in a direction X, each mirror elongated generally along a drift direction Y, the drift direction Y being orthogonal to the direction X;

a pulsed ion injector for injecting pulses of ions into the space between the ion mirrors, the ions entering the space at a non-zero inclination angle to the X direction, the ions thereby forming an ion beam that follows a zigzag ion path having N reflections between the ion mirrors in the direction X whilst drifting along the drift direction Y;

a detector for detecting ions after completing the same number N of reflections between the ion mirrors; and an ion focusing arrangement at least partly located between the opposing ion mirrors and configured to provide focusing of the ion beam in the drift direction Y, such that a spatial spread of the ion beam in the drift direction Y passes through a single minimum at or immediately after a reflection having a number between 0.25N and 0.75N, wherein all detected ions are detected after completing the same number N of reflections between the ion mirrors.

2. The multi-reflection mass spectrometer of claim 1 wherein the spatial spread of the ion beam in the drift direction on the first reflection is substantially the same as the spatial spread of the ion beam in the drift direction on the N-th reflection.

3. The multi-reflection mass spectrometer of claim 1 wherein the spatial spread of the ion beam in the drift direction Y passes through a single minimum that is substantially halfway along the ion path between the ion focusing arrangement and the detector.

4. The multi-reflection mass spectrometer of claim 1 wherein the ion focusing arrangement comprises a drift focusing lens or pair of drift focusing lenses for focusing the ions in the drift direction Y.

5. The multi-reflection mass spectrometer of claim 4 wherein at least one drift focusing lens is a converging lens.

6. The multi-reflection mass spectrometer of claim 5 wherein the converging lens focuses the ions such that the spatial spread of the ion beam in the drift direction Y has a maximum at the converging lens that is 1.2-1.6 times, or about √2 times, the spatial spread at the minimum.

7. The multi-reflection mass spectrometer of claim 5 wherein the spatial spread of the ion beam in the drift direction Y has a maximum at the converging lens that is in the range 2× to 20× an initial spatial spread of the ion beam in the drift direction Y at the ion injector.

8. The multi-reflection mass spectrometer of claim 1 wherein the ion beam undergoes K oscillations between the ion mirrors from the ion injector to the ion detector and K is a value within a range that is +/−50%, or +/−40%, or +/−30%, or +/−20%, or +/−10% around an optimum value, $K_{(opt)}$ given by:

$$K(opt) = \left(\frac{D_L^2}{4\Pi W}\right)^{1/3}$$

wherein $D_L$ is the drift length travelled by the ion beam in the drift direction Y, Π is the phase volume wherein $\Pi = \delta\alpha_i \cdot \delta x_i$ and $\delta\alpha_i$ is the initial angular spread and $\delta x_i$ is the initial spatial spread of the ion beam at the ion injector, and W is the distance between the ion mirrors in the X direction.

9. The multi-reflection mass spectrometer of claim 1 wherein the angular spread of the ion beam, δα, after focusing by the ion focusing arrangement is within a range that is +/−50%, or +/−40%, or +/−30%, or +/−20%, or +/−10% around an optimum value, $\delta\alpha_{(opt)}$ given by:

$$\delta\alpha(opt) = \sqrt{\frac{2\Pi}{WK(opt)}}.$$

10. The multi-reflection mass spectrometer of claim 1 wherein the ion focusing arrangement is located before a reflection having a number less than 0.25N in the ion mirrors.

11. The multi-reflection mass spectrometer of claim 1 wherein the initial spatial spread of the ion beam in the drift direction Y at the ion injector, $\delta x_i$, is 0.25-10 mm or 0.5-5 mm.

12. The multi-reflection mass spectrometer of claim 1 wherein the ion focusing arrangement comprises a drift focusing lens positioned after a first reflection and before a fifth reflection in the ion mirrors.

13. The multi-reflection mass spectrometer of claim 12 wherein the ion focusing arrangement comprises a drift focusing lens positioned after a first reflection in the ion mirrors and before a second reflection in the ion mirrors.

14. A multi-reflection mass spectrometer of claim 12 wherein the drift focusing lens is the only drift focusing lens positioned between the first reflection and the ion detector.

15. The multi-reflection mass spectrometer of claim 12 wherein the drift focusing lens comprises a trans-axial lens, wherein the trans-axial lens comprises a pair of opposing lens electrodes positioned either side of the beam in a direction Z, wherein direction Z is perpendicular to directions X and Y.

16. The multi-reflection mass spectrometer of claim 15 wherein each of the opposing lens electrodes comprises a circular, elliptical, quasi-elliptical or arc-shaped electrode.

17. The multi-reflection mass spectrometer of claim 15 to wherein each of the pair of opposing lens electrodes comprises an array of electrodes separated by a resistor chain to mimic a field curvature created by an electrode having a curved edge.

18. The multi-reflection mass spectrometer of claim 15 wherein the drift focusing lens comprises a multipole rod assembly or an Einzel lens.

19. The multi-reflection mass spectrometer of claim 15 wherein the lens electrodes are each placed within an electrically grounded assembly.

20. The multi-reflection mass spectrometer of claim 15 wherein the lens electrodes are each placed within a deflector electrode.

21. The multi-reflection mass spectrometer of claim 20 wherein the deflector electrodes have an outer trapezoid shape that acts as a deflector of the ion beam.

22. The multi-reflection mass spectrometer of claim 1 wherein the ion focusing arrangement comprises a first drift focusing lens positioned before the first reflection in the ion mirrors for focusing the ion beam in the drift direction Y, wherein the first drift focusing lens is a diverging lens, and a second drift focusing lens positioned after the first reflection in the ion mirrors for focusing the ion beam in the drift direction Y, wherein the second drift focusing lens is a converging lens.

23. The multi-reflection mass spectrometer of claim 1 wherein the ion focusing arrangement comprises at least one injection deflector positioned before the first reflection in the ion mirrors.

24. The multi-reflection mass spectrometer of claim 23 when dependent on claim 22, wherein the first drift focusing lens is placed within the at least one injection deflector.

25. The multi-reflection mass spectrometer of claim 1 wherein the inclination angle to the X direction of the ion beam is determined by an angle of ion ejection from the pulsed ion injector relative to the direction X and/or a deflection caused by the injection deflector.

26. The multi-reflection mass spectrometer of claim 1 further comprising one or more compensation electrodes extending along at least a portion of the drift direction Y in or adjacent the space between the mirrors for minimising time of flight aberrations.

27. The multi-reflection mass spectrometer of claim 1 further comprising a reversing deflector located at a distal end of the ion mirrors from the ion injector to reduce or reverse the drift velocity of the ions in the direction Y.

28. The multi-reflection mass spectrometer of claim 27 further comprising a further drift focusing lens located between the opposing ion mirrors one, two or three reflections before the reversing deflector to focus the ion beam to a focal minimum within the reversing deflector.

29. The multi-reflection mass spectrometer of claim 27 further comprising a further drift focusing lens positioned within the reversing deflector to focus the ion beam to a focal minimum within one of the ion mirrors at the next reflection after the reversing deflector.

30. The multi-reflection mass spectrometer of claim 29 wherein the detector is located at an opposite end of the ion mirrors in the drift direction Y from the ion injector and wherein the ion mirrors diverge from each other along a portion of their length in the direction Y as the ions travel towards the detector.

31. The multi-reflection mass spectrometer of claim 30 wherein, starting from the end of the ion mirrors closest to the ion injector, the ion mirrors converge towards each other along a first portion of their length in the direction Y and diverge from each other along a second portion of their length in the direction Y, the second portion of length being adjacent the detector.

32. The multi-reflection mass spectrometer of claim 1 wherein the ion detector is an imaging detector.

33. A method of mass spectrometry comprising:

injecting ions into a space between two ion mirrors that are spaced apart and opposing each other in a direction X, each mirror elongated generally along a drift direction Y, the drift direction Y being orthogonal to the direction X, the ions entering the space at a non-zero inclination angle to the X direction, the ions thereby forming an ion beam that follows a zigzag ion path having N reflections between the ion mirrors in the direction X whilst drifting along the drift direction Y, focusing the ion beam in the drift direction Y using an ion focusing arrangement at least partly located between the opposing ion mirrors, such that a spatial spread of the ion beam in the drift direction Y passes through a single minimum at or immediately after a reflection having a number between 0.25N and 0.75N, wherein all detected ions are detected after completing the same number N of reflections between the ion mirrors, and detecting ions after the ions have completed the same number N of reflections between the ion mirrors.

34. The method of mass spectrometry of claim 33 wherein the focusing is such that the spatial spread of the ion beam in the drift direction on the first reflection is substantially the same as the spatial spread of the ion beam in the drift direction on the N-th reflection.

35. The method of mass spectrometry of claim 33 wherein the focusing is such that the spatial spread of the ion beam in the drift direction Y passes through a single minimum that is substantially halfway along the ion path between the ion focusing arrangement and the detector.

36. The method of mass spectrometry of any claim 33 wherein the ion beam undergoes K oscillations between the ion mirrors and K is a value within a range that is +/−50%, or +/−40%, or +/−30%, or +/−20%, or +/−10% around an optimum value, $K_{(opt)}$ given by:

$$K(opt) = \left(\frac{D_L^2}{4\Pi W}\right)^{1/3}$$

wherein $D_L$ is the drift length travelled by the ion beam in the drift direction Y, Π is the phase volume wherein $\Pi = \delta\alpha_i \cdot \delta x_i$ and $\delta\alpha_i$ is an initial angular spread and $\delta x_i$ is an initial spatial spread of the ion beam, and W is the distance between the ion mirrors in the X direction.

37. The method of mass spectrometry of claim 33 wherein the angular spread of the ion beam, δα, after focusing is within a range that is +/−50%, or +/−40%, or +/−30%, or +/−20%, or +/−10% around an optimum value, $\delta\alpha_{(opt)}$ given by:

$$\delta\alpha(opt) = \sqrt{\frac{2\Pi}{WK(opt)}}.$$

38. The method of mass spectrometry of claim 33 wherein the focusing is performed using an ion focusing arrangement located before a reflection having a number less than 0.25N in the ion mirrors.

39. The method of mass spectrometry of claim 33 wherein an initial spatial spread of the ion beam in the drift direction Y at an ion injector, $\delta x_i$, is 0.25-10 mm or 0.5-5 mm.

40. The method of mass spectrometry of claim 33 wherein the ion focusing arrangement comprises a drift focusing lens positioned after a first reflection in the ion mirrors and before a fifth reflection in the ion mirrors.

41. The method of mass spectrometry of claim 33 further comprising deflecting the ion beam using a deflector positioned after a first reflection in the ion mirrors and before a fifth reflection in the ion mirrors.

42. The method of mass spectrometry of claim 33 wherein the ion focusing arrangement comprises a first drift focusing lens positioned before the first reflection in the ion mirrors for focusing the ion beam in the drift direction Y, wherein the first drift focusing lens is a diverging lens, and a second drift focusing lens positioned after the first reflection in the ion mirrors for focusing the ion beam in the drift direction Y, wherein the second drift focusing lens is a converging lens.

43. The method of mass spectrometry of claim 33 further comprising adjusting the inclination angle to the X direction of the ion beam by deflecting the ion beam using an injection deflector positioned before the first reflection in the ion mirrors.

44. The method of mass spectrometry of claim 33 further comprising applying one or more voltages to respective one or more compensation electrodes extending along at least a portion of the drift direction Y in or adjacent the space between the mirrors to minimise time of flight aberrations.

45. The method of mass spectrometry of claim 33 further comprising deflecting the ion beam using a reversing deflector at a distal end of the ion mirrors from the injection to reduce or reverse the drift velocity of the ions in the direction Y.

46. The method of mass spectrometry of claim 45 further comprising focusing the ion beam to a focal minimum within the reversing deflector.

47. The method of mass spectrometry of claim 45 further comprising providing a focusing lens within the reversing deflector and focusing the ion beam to a focal minimum within one of the ion mirrors at the next reflection after the reversing deflector.

48. The method of mass spectrometry of claim 33 wherein the detecting comprises forming a 2-D image of an ion source.

* * * * *